US012297642B1

(12) United States Patent
Bordovsky et al.

(10) Patent No.: US 12,297,642 B1
(45) Date of Patent: May 13, 2025

(54) MODULAR INTERLOCKING ASSEMBLY SYSTEM

(71) Applicants: Brian Bordovsky, Coralville, IA (US); Brent Bordovsky, Siloam Springs, AR (US)

(72) Inventors: Brian Bordovsky, Coralville, IA (US); Brent Bordovsky, Siloam Springs, AR (US)

(73) Assignee: Truly Modular Systems, Coralville, IA (US)

( * ) Notice: Subject to any disclaimer, the term of this patent is extended or adjusted under 35 U.S.C. 154(b) by 415 days.

(21) Appl. No.: 17/964,011

(22) Filed: Oct. 11, 2022

Related U.S. Application Data

(60) Provisional application No. 63/262,357, filed on Oct. 11, 2021.

(51) Int. Cl.
*E04B 2/18* (2006.01)
*E04B 1/343* (2006.01)

(52) U.S. Cl.
CPC ..... *E04B 2/18* (2013.01); *E04B 1/34331* (2013.01)

(58) Field of Classification Search
CPC ..... E04B 2/18; E04B 1/34331
See application file for complete search history.

(56) References Cited

U.S. PATENT DOCUMENTS 3,456,413 A * 7/1969 Artur ..... A63H 33/084 D25/120
3,546,792 A 12/1970 Sherman
3,600,867 A * 8/1971 Shuey ..... E04B 2/08 52/302.1
3,645,569 A 2/1972 Reilly
3,822,499 A 7/1974 De
3,905,150 A 9/1975 Dawn
4,071,990 A * 2/1978 Traber ..... E04B 2/7453 403/231
4,202,131 A 5/1980 Poleri
4,381,619 A 5/1983 Griffin
4,432,590 A * 2/1984 Lawrence ..... A47B 47/04 403/231
4,699,602 A 10/1987 Giorgi
5,554,062 A 9/1996 Goldsen
5,580,181 A 12/1996 Nomura
(Continued)

FOREIGN PATENT DOCUMENTS

AU 2010201516 A1 2/2011
AU 2011101075 A4 9/2011
(Continued)

*Primary Examiner* — Rodney Mintz
(74) *Attorney, Agent, or Firm* — HAMILTON IP LAW; Jay R. Hamilton

(57) ABSTRACT

A system of individual components that interlock and secure to create a rigid structure using a modular system is disclosed. The modular system is further comprised of a combination individual connectors, rails, and panels. The individual components can be used to build either rectangular cuboids, cubic, non-cubic structures, and/or combinations thereof in primarily two-dimensional or three-dimensional structures as the components may be designed to join or interlock together with or without the aid of consecutive joining pieces. A rectangular cuboid on its own can be used for boxes, shipping crates, storage units, etc. without limitation.

19 Claims, 17 Drawing Sheets

(56) References Cited

U.S. PATENT DOCUMENTS

| | | | | |
|---|---|---|---|---|
| 5,596,843 | A * | 1/1997 | Watson | A01G 9/1415 52/63 |
| 5,826,394 | A * | 10/1998 | Barton, Jr. | A63H 33/062 52/592.1 |
| 5,848,500 | A * | 12/1998 | Kirk | E04B 1/5831 403/231 |
| 5,928,052 | A | 7/1999 | Buscher | |
| 6,059,631 | A | 5/2000 | Maddock | |
| 6,558,222 | B1 | 5/2003 | Maddock | |
| 6,792,732 | B2 | 9/2004 | Strässle et al. | |
| 7,322,873 | B2 | 1/2008 | Rosen et al. | |
| 7,988,517 | B2 | 8/2011 | Bishop | |
| 8,402,710 | B2 * | 3/2013 | Cables | E04B 2/46 52/574 |
| 8,789,325 | B2 * | 7/2014 | Verhaeghe | E04B 2/705 52/561 |
| 9,416,534 | B2 * | 8/2016 | Kovitch | E04B 2/18 |
| 9,458,874 | B2 | 10/2016 | Sim | |
| 9,821,241 | B2 | 11/2017 | Haner | |
| D823,669 | S | 7/2018 | MacDonald et al. | |
| 10,036,156 | B1 | 7/2018 | MacDonald et al. | |
| D826,692 | S | 8/2018 | MacDonald et al. | |
| D839,075 | S | 1/2019 | MacDonald et al. | |
| 10,662,650 | B2 * | 5/2020 | Lacroix | E04C 3/06 |
| 11,123,652 | B2 | 9/2021 | Haldeman | |
| 11,511,210 | B2 * | 11/2022 | Gat | A63H 33/082 |
| 11,788,275 | B2 * | 10/2023 | Silfverberg | E04B 2/18 52/586.1 |
| 2002/0189191 | A1 * | 12/2002 | Strassle | E04B 2/78 403/171 |
| 2005/0191932 | A1 | 9/2005 | Lin | |
| 2005/0230910 | A1 | 10/2005 | Urriza | |
| 2006/0134978 | A1 * | 6/2006 | Rosen | H01R 13/514 439/581 |
| 2007/0125016 | A1 | 6/2007 | Yu et al. | |
| 2008/0280523 | A1 * | 11/2008 | Bishop | A63H 33/082 446/124 |
| 2010/0095631 | A1 | 4/2010 | Cables | |
| 2010/0176697 | A1 | 7/2010 | Fuerstenau | |
| 2013/0237120 | A1 | 9/2013 | Haner | |
| 2013/0263554 | A1 * | 10/2013 | Verhaeghe | E04B 2/705 52/775 |
| 2014/0230357 | A1 * | 8/2014 | Kovitch | E04B 2/08 52/588.1 |
| 2014/0241794 | A1 * | 8/2014 | Sim | F16B 7/20 403/349 |
| 2014/0331590 | A1 * | 11/2014 | Goltsman | E04B 2/26 52/592.5 |
| 2019/0127978 | A1 * | 5/2019 | Lacroix | E04C 3/06 |
| 2020/0360831 | A1 * | 11/2020 | Haldeman | A63H 33/082 |
| 2021/0101087 | A1 | 4/2021 | Hu | |
| 2021/0245037 | A1 | 8/2021 | Gat | |
| 2021/0404176 | A1 * | 12/2021 | Silfverberg | E04B 1/08 |

FOREIGN PATENT DOCUMENTS

| | | | |
|---|---|---|---|
| CN | 203663454 | U | 6/2014 |
| CN | 103958015 | A | 7/2014 |
| CN | 206508558 | U | 9/2017 |
| CN | 206652251 | U | 11/2017 |
| CN | 109966761 | A | 7/2019 |
| CN | 209348120 | U | 9/2019 |
| CN | 209908911 | U | 1/2020 |
| CN | 212119040 | U | 12/2020 |
| CN | 113041633 | A | 6/2021 |
| CN | 213407746 | U | 6/2021 |
| CN | 214075056 | U | 8/2021 |
| CN | 214075058 | U | 8/2021 |
| CN | 214075060 | U | 8/2021 |
| EP | 1637200 | A1 | 12/2008 |
| EP | 3175896 | A1 | 9/2021 |
| JP | H11179067 | A | 7/1999 |
| JP | 2010279671 | A | 12/2010 |
| JP | 2012163158 | A | 8/2012 |
| JP | 2017213328 | A | 12/2017 |
| KR | 101414360 | B1 | 7/2014 |
| KR | 101551226 | B1 | 9/2015 |
| RU | 177335 | U1 | 2/2018 |
| TW | 200940143 | A | 10/2009 |
| WO | 9415688 | A1 | 7/1994 |
| WO | 2013122447 | A1 | 8/2013 |

* cited by examiner

MODULAR INTERLOCKING ASSEMBLY SYSTEM

CROSS REFERENCE TO RELATED APPLICATIONS

This nonprovisional utility patent application claims priority from provisional U.S. Pat. App. No. 63/262,357 filed on Oct. 11, 2021, which is incorporated by reference herein in its entirety.

FIELD OF THE INVENTION

The present disclosure relates to a set of components (connectors, rails, and panels) useful for creating a three-dimensional rectilinear structure for use in a variety of both commercial and non-commercial applications.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

AUTHORIZATION PURSUANT TO 37 C.F.R. § 1.171 (d)

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyrights whatsoever.

BACKGROUND

The present disclosure relates to a set of components (connectors, rails, and panels) used for creating three dimensional units (which in one illustrative embodiment may be cubic in shape), interlocking units or rigid structures of varying designs. The system of three separate interlocking components (connectors, rails, and panels) can be used to create an infinite number rectangular cuboids on an X-Y-Z grid. Users are not bound to building or utilizing cubes. Any three-dimensional structure the user can imagine being built using these components is an enhancing quality of the system.

The disclosure described in this application can be used in a wide variety of ways which can include shelving, boxes/crates, furniture, office applications, storage bins, toys, gardening fixtures, display systems, etc. The design of the system allows for easy assembly/disassembly and additions/subtractions of components that connect together to create a rigid self-supporting unit. When not in use the assembly can be broken down into individual components. The components are designed to be used repeatedly. The ability to re-use every component saves resources.

The disclosure described in this application is designed to be used by a wide audience which can consist of private entities and public consumers. It is not restricted to any type of industry or commercial application but is intended to be used by anyone who has a need for an easy-to-use system of interlocking components that can be used to build two- or three-dimensional rectilinear shapes and/or structures. Components of the system can be constructed of different materials. Metal, plastic, and wood may be desirable materials for certain applications of the components and other materials could be used depending on the user's intended use.

There are numerous modular style assembly systems available, but many are complex, have limited uses and assembly requires multiple connectors/screws/nuts etc. The disclosure described in this application addresses complexity issues with a three-component assembly system that connects together in a pattern to create a rigid rectangular cuboid structure. It is not limited to just one grid unit height such as a fixed Z dimension and variable X and Y dimensions. It allows for an infinite addition of rectangular cuboids in all XYZ directions. Users are free to make any structure they can using the components. Structural integrity is achieved through the inherent design of the components.

It is an object of the present disclosure to provide a methodology to build and assemble rectangular cuboid-type structures. It is a further object of this disclosure to provide illustrative embodiments of structures useful in building rectangular cuboid structures. Other objects and/or advantages of the present disclosure may exist and/or become apparent in light of the present disclosure without limitation unless otherwise indicated in the following claims.

SUMMARY

The present disclosure is a modular rectangular cuboid assembly system consisting of slotted connectors, grooved rails, and ribbed panels, designed to assemble in a 3-dimensional orthogonal grid. Design properties of the components allow for the creation of rectangular cuboids (which in one illustrative embodiment may be cubes), connected rectangular cuboids or any structure the user desires and can create with those components.

Design properties of the components allow a grid array of modular rectangular cuboid units to be achieved and to expand without restrictions in each of the X, Y and Z axes indefinitely. Using the three separate components (connectors, rails, panels) one can make a rectangular cuboid assembly structure that holds together by its own merit and creates a sturdy rigid unit. As the connectors, rails and panels are connected, they work together to restrict movement relative to one another and provide stability to the entire assembly. The assembly obtains structural integrity by the inherent design features of each component and how they connect to each other. The geometry of the components restricts components from moving relative to one another.

A single assembled rectangular cuboid consisting of eight connectors, twelve rails and six panels is a primary basic structure of the disclosure. This is a single enclosed rectangular cuboid structure. This rectangular cuboid alone can satisfy many of the applicable needs. This rectangular cuboid alone with all six panels is inherently stable and is designed to support weight as a standalone structure. The subtraction of panels from the rectangular cuboid is achievable and gives the user options for having an open rectangular cuboid face allowing for access to the interior of the rectangular cuboid. The design allows for quick removal and addition of panels as the user desires.

Connectors may also be rectangular cuboids, and in one illustrative embodiment may be configured as a cube. In one illustrative embodiment all six sides may be configured of equal dimensions. Each connector may be formed with a slot on each side that may receive a peg located at the end of each rail. Slot geometry can vary and may generally be configured to prevent rails from moving away from the connector in the dimension perpendicular to that of the connector face. The connector may allow for a maximum of six rails to connect to all six sides. Secure connection may be achieved through either a tight fit or snap like feature of the peg that flexes into place or a locking mechanism that can lock the components together.

Rails may be of a square beam design. Rails may include a groove or channel on each long axis side. Each groove or channel may receive one side of one panel. In an illustrative embodiment a rail may have two grooves configured with profiles that match the profile of the connector slot geometry and two of the channels may be configured with a geometry that matches the geometry of a standard edge of a panel.

The rails may be configured with a peg at either or both square ends. Each peg may be designed to fit into a connector slot. Pegs may be designed to move freely along rail grooves of other rails. Panels may be primarily rectilinear, three-dimensional planes. Each panel may be configured with at least one rib edge, and in an illustrative embodiment may include two rib edges on opposite sides of the panel, wherein each rib edge may be configured to engage a rail groove. The panel ribs may also be configured to engage a slot in the connectors. The panels may be inserted into the assembled connectors and rails. Panels may be inserted in a direction parallel with the slots in the connectors. When assembled with four rails and four connectors in a square, the connectors and rails may hold the panel securely in place.

The ability to have modified components work together with basic components to achieve a specific structure is one of the qualities of the disclosure without limitation unless otherwise indicated in the following claims. The basic component design and how they fit together is the basis for all the intended applications.

Assembly of a rectangular cuboid with five panels can be achieved through basic maneuvers of fitting the components together. Assembly of a rectangular cuboid with all six panels may require the use of at least one or more modified components (a modified panel or a modified rail). The assembly of a rectangular cuboid using eight connectors, twelve rails, and six panels is achievable in different ways. One can assemble a fully enclosed rectangular cuboid by switching out two of the panels with panels that only have rib edges on opposite ends. Another way to assemble a fully enclosed rectangular cuboid is to switch out one rail for a modified rail that is not prevented from completing the rectangular cuboid by the rib edge.

Addition of pieces to a fully enclosed rectangular cuboid is an inherent quality of the design. It is only a matter of adding more rails and connectors and panels to the user's desired design. There is no limit to how many rectangular cuboid can be added and no limit as to what direction they can be added. The ease of use is inherently created through the design of the components.

As disclosed, the system and components are modular. All connections may be made in the same manner. Rails only connect to cubes one way. Panels slide into rails only one way. The main concept requires no moving parts. Other variations might require additional parts or modified parts to achieve specific functionality. There are no separate fasteners, screws, clips etc. for the disclosure to function. There are no protruding pieces that hinder further assembly. There is no confusion as to what components go where and how they fit together. Additional tools for assembly are not needed. Tools or specific tools would only be needed on variations that required additional modifications.

If a specific assembly system is required and cannot be achieved through assembly of standard components any of the components can be modified to meet the specific needs. While this is not the inherent principle of the system design it is through this flexibility that allows a multitude of different assembled systems to be achieved. Components can be made from plastic, metal, wood, carbon fiber, composite materials etc. Some materials might have distinct advantages over others depending on the desired use. Translucent panels are achievable with certain materials.

Components that are different materials can still be used together. A connector made from plastic and a rail made from metal do not disqualify the two components from working together. As disclosed, the modular interlocking assembly is scalable. The components disclosed need to each be a specific size relative to each other in order to work together but the modular interlocking assembly can be scaled to smaller or larger sizes. As the size of components is increased greater functionality of the system or components of the system might be achievable as more complex component modification can occur.

DETAILED DESCRIPTION—BRIEF DESCRIPTION OF THE FIGURES

The accompanying drawings, which are incorporated in and constitute a part of this specification, illustrate embodiments and together with the description, serve to explain the principles of the methods and systems.

Figure 3:
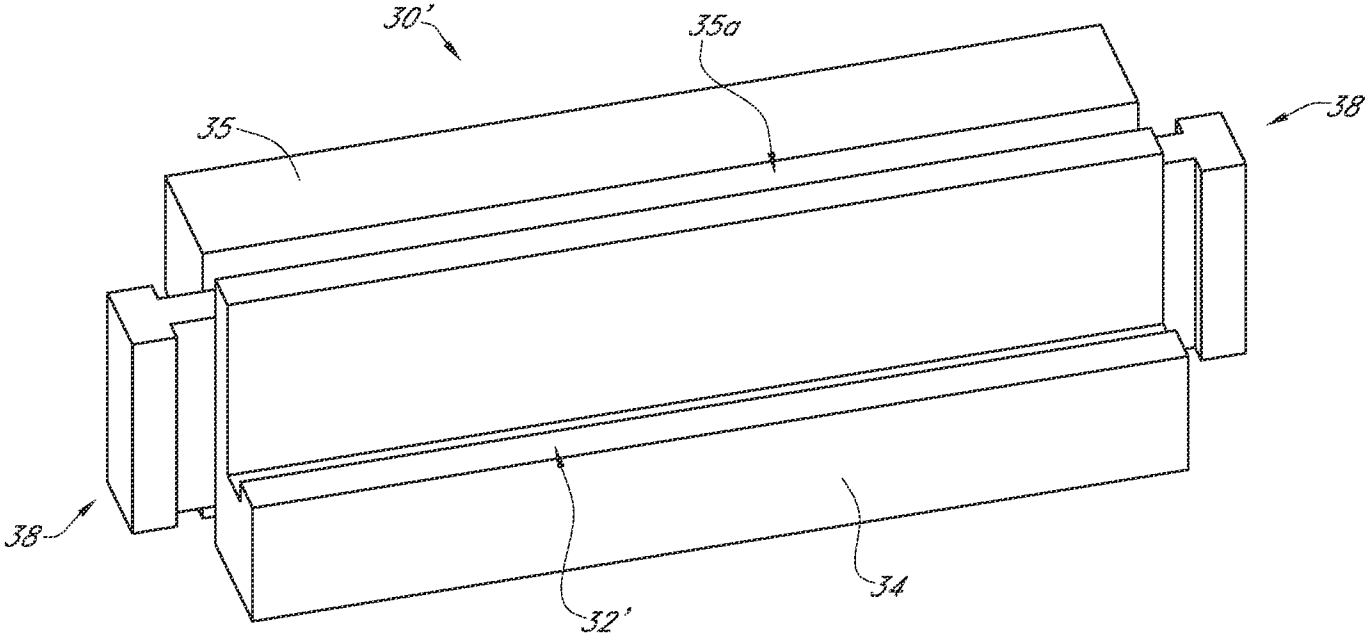
FIG. 3 is a perspective view of an illustrative embodiment of a modified rail 30'.
Figure 3A:
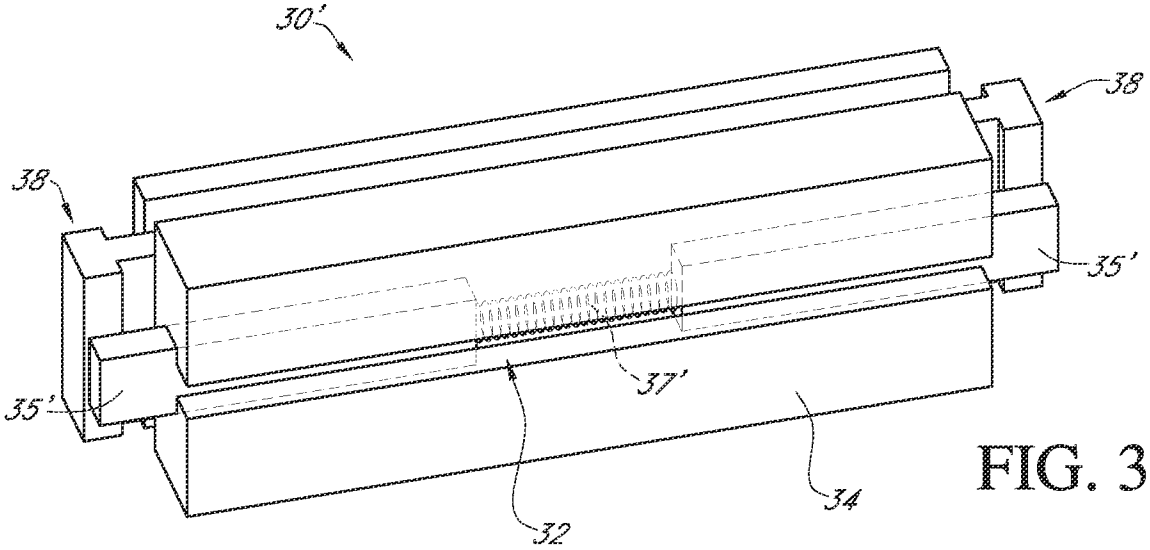

FIG. 3A is another perspective view of the modified rail 30' from the other side illustrating the locking tab 35' and biasing member 37' positioned therein for locking the modified rail 30' between connectors 20.

Figure 3B:
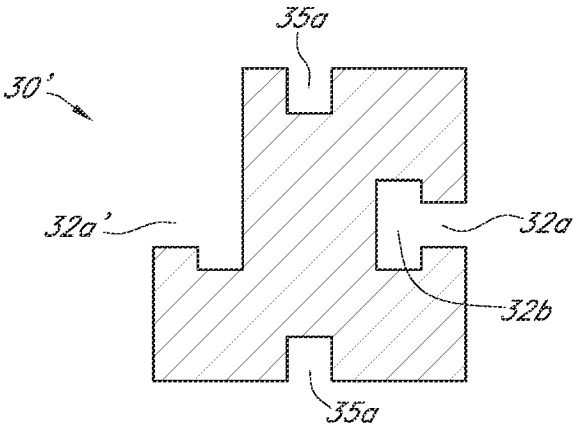

FIG. 3B is an end view of the modified rail 30' of FIG. 3.

Figure 4:
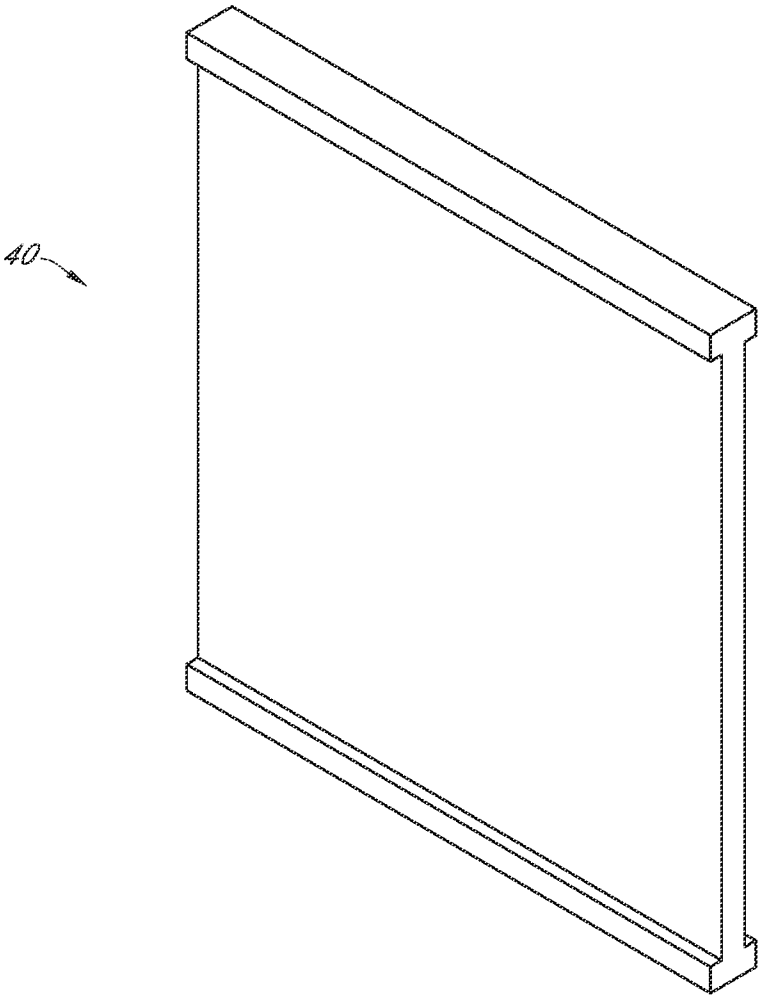

FIG. 4 is a perspective view of an illustrative embodiment of a panel 40.

Figure 4B:
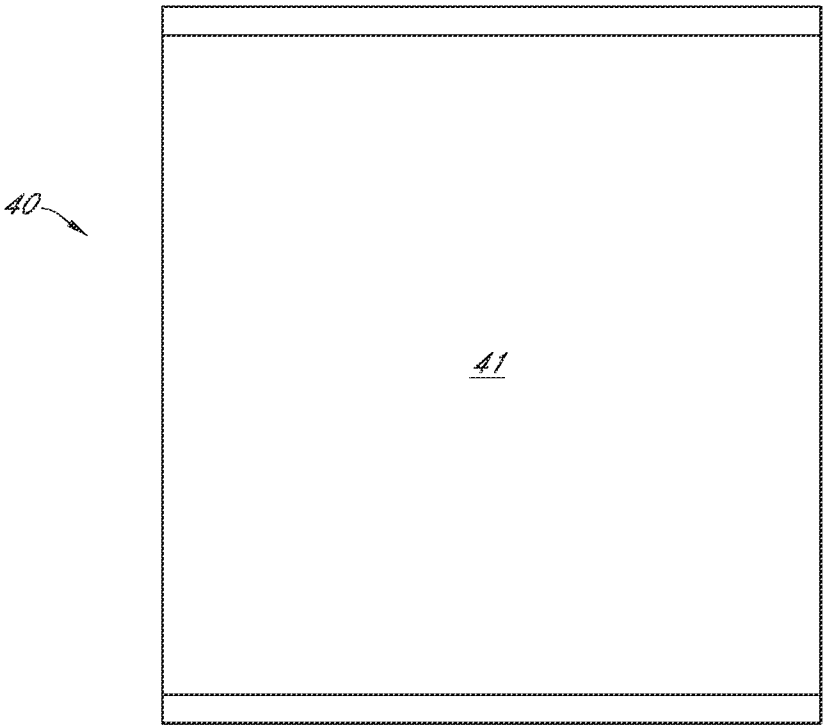
Figure 4A:
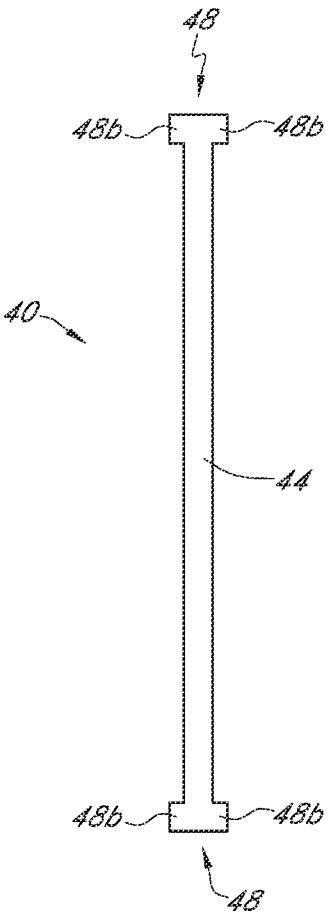

FIG. 4A is an end (sectional) view of the panel 40 of FIG. 3.

FIG. 4B is a top view of the panel 40 of FIG. 4.

Figure 5:
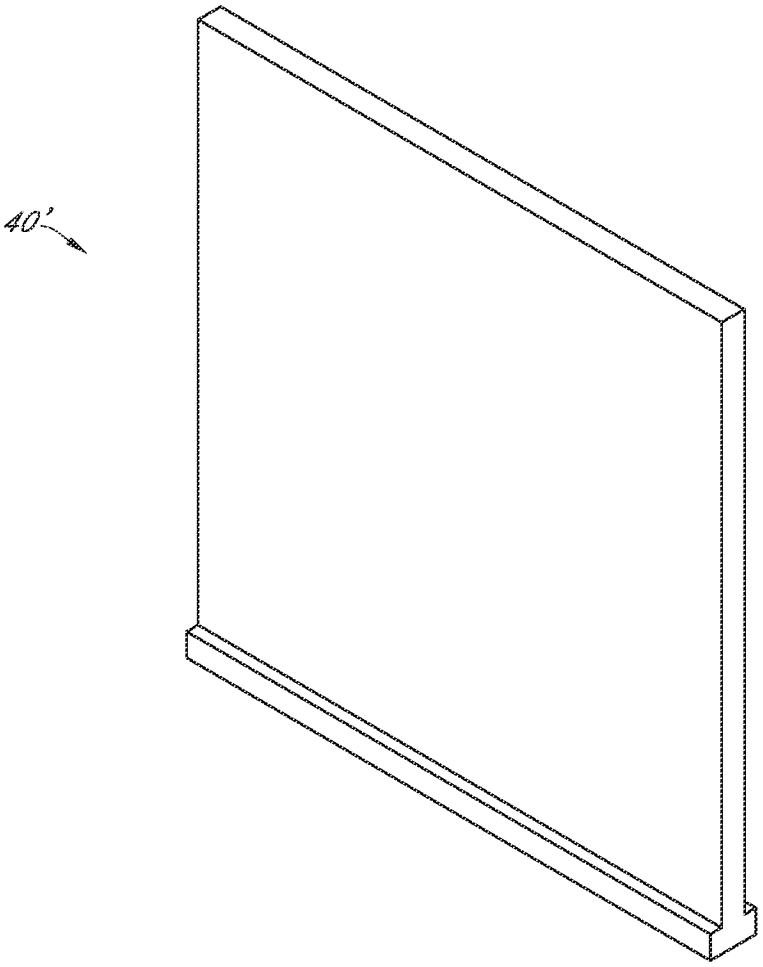

FIG. 5 is a perspective view of a modified panel 40'.

Figure 6:
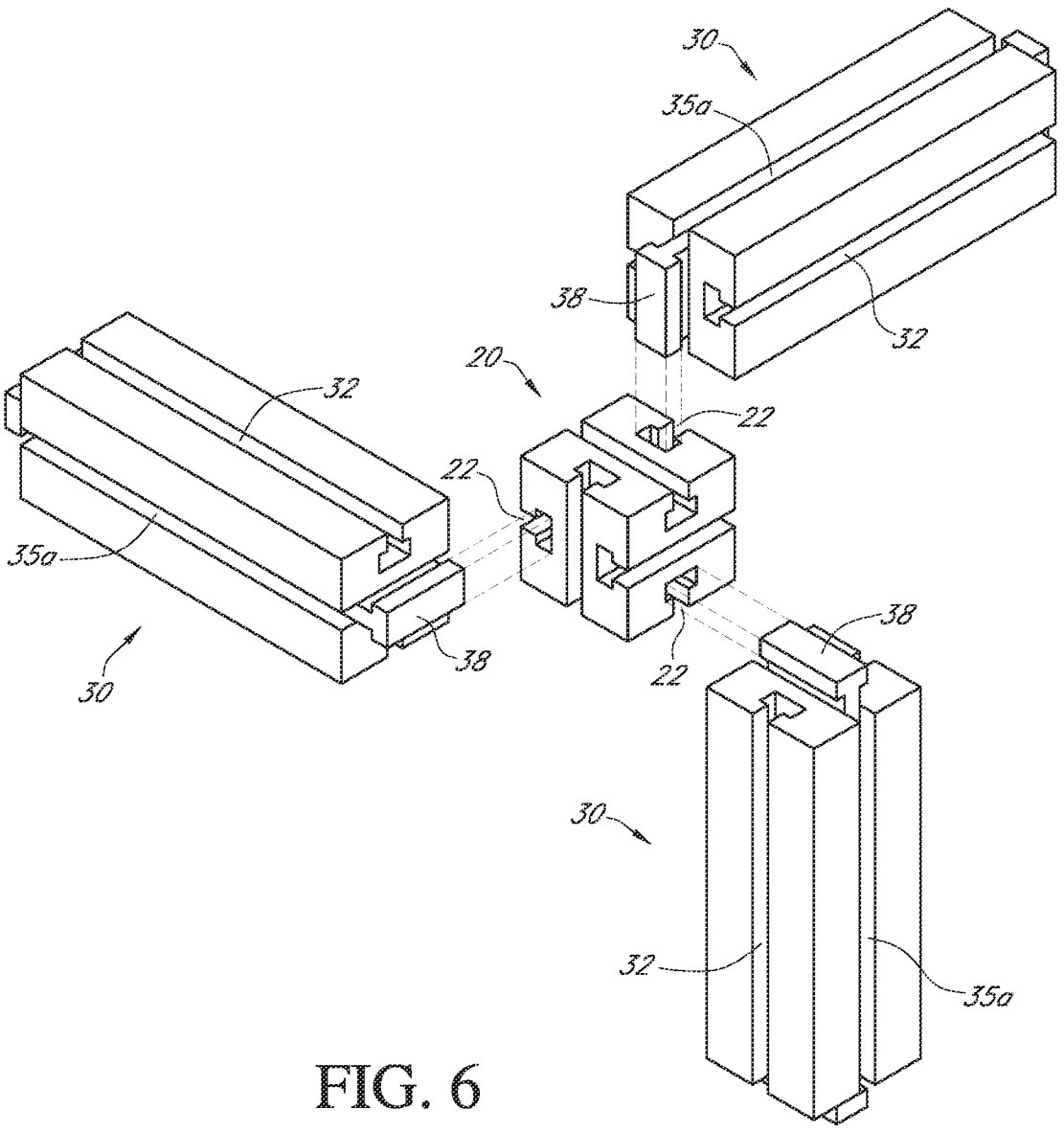

FIG. 6 illustrates a connector 20 and three rails 30 prior to connection.

Figure 7:
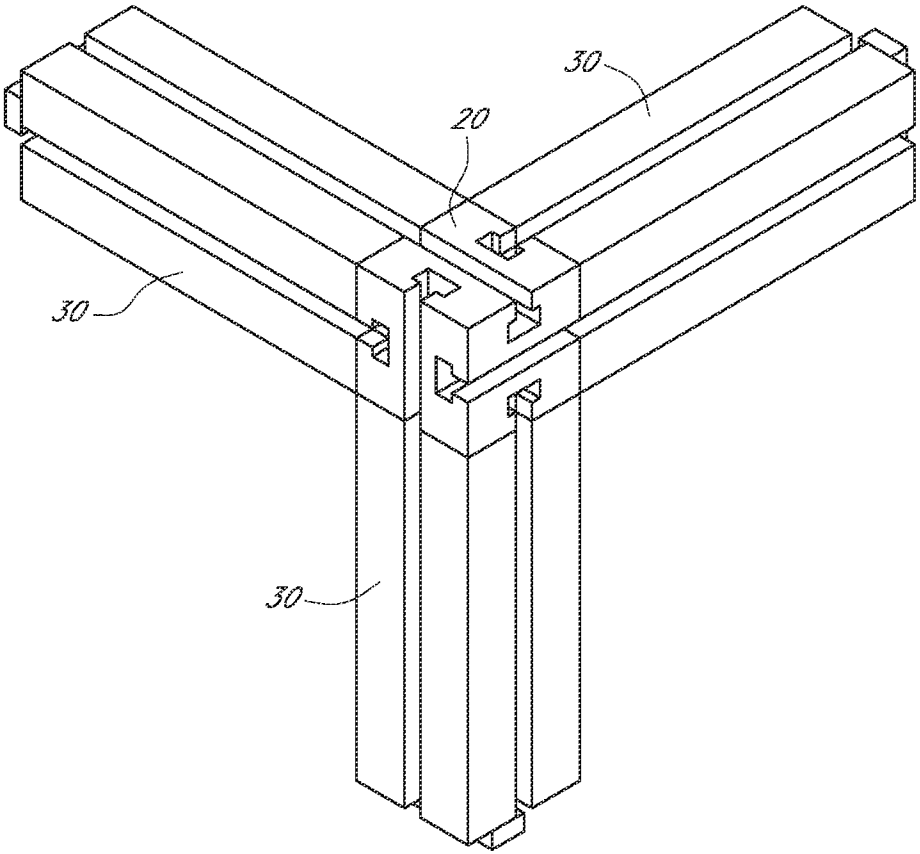

FIG. 7 illustrates the connector 20 and three rails 30 assembled together from FIG. 6.

Figure 8:
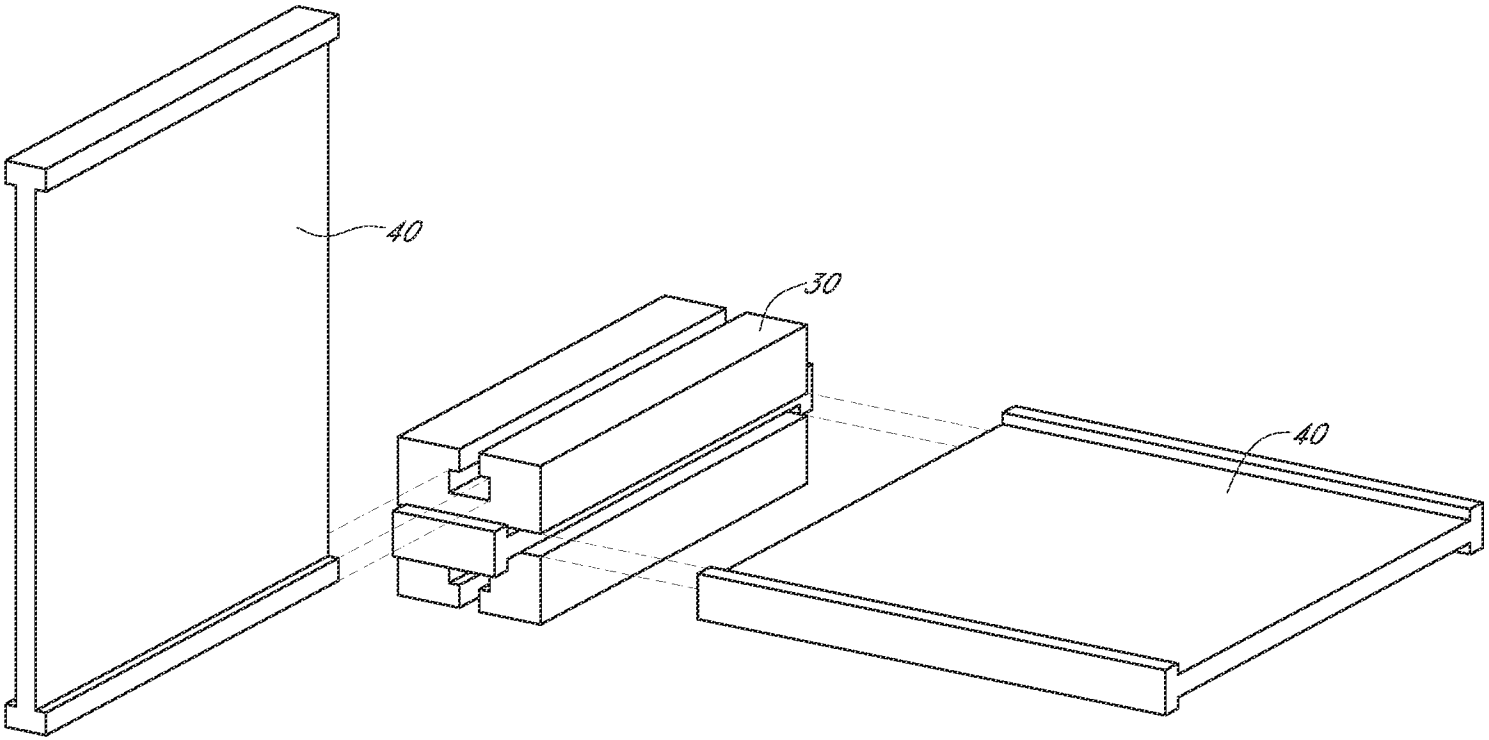

FIG. 8 illustrates a rail 30 and two panels 40.

Figure 9:
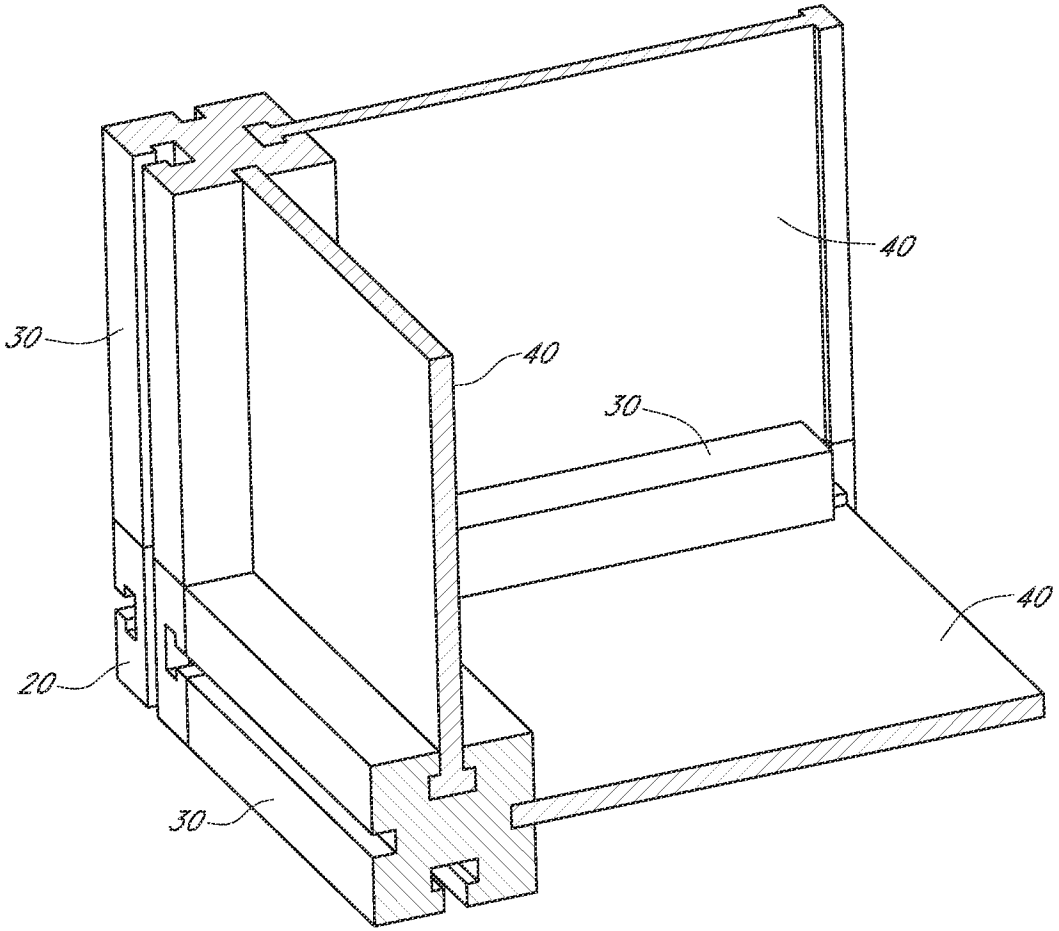

FIG. 9 illustrates a connector 20 fitted together with three rails 30 and three panels 40.

Figure 10:
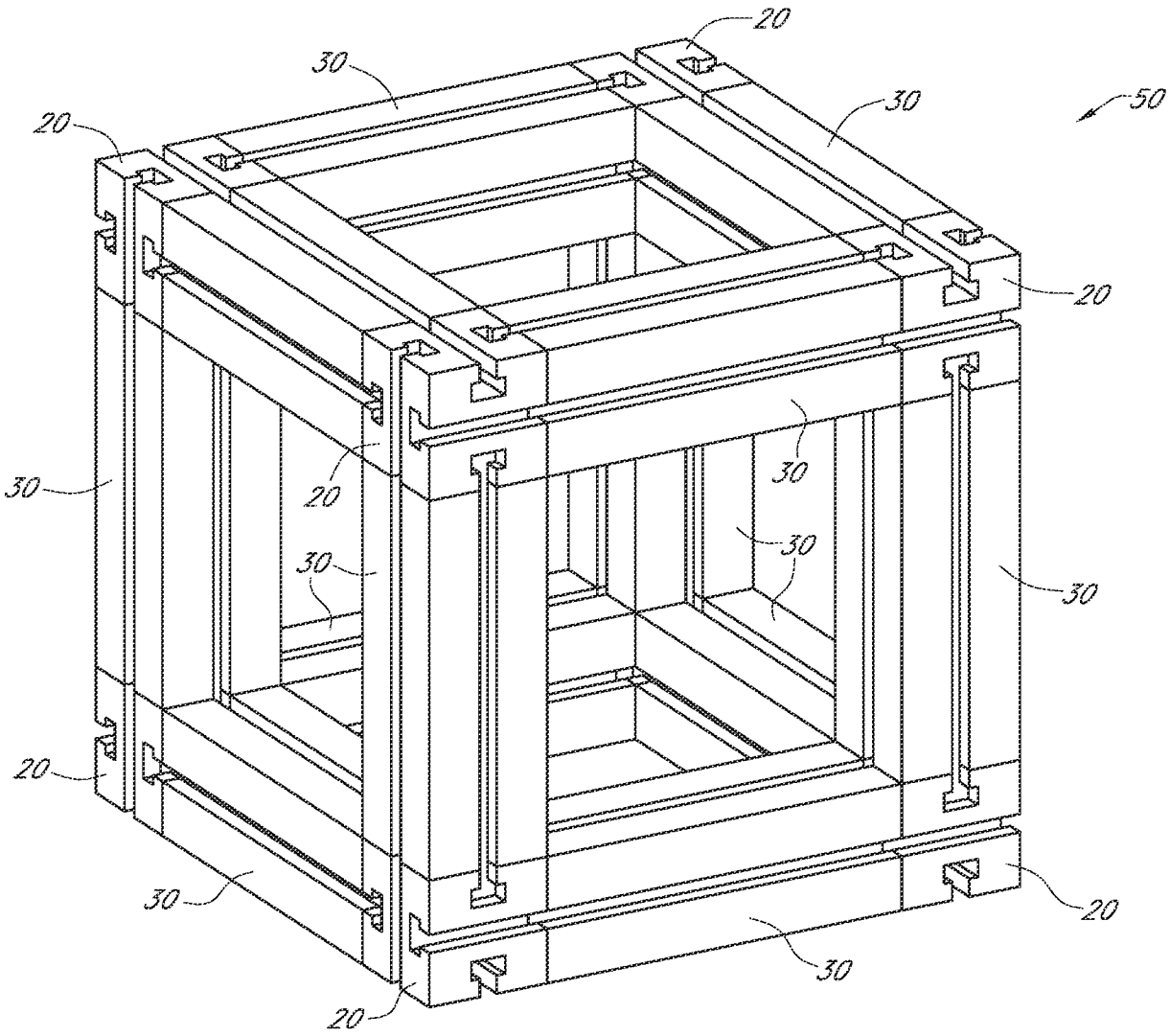

FIG. 10 illustrates the modular system 10 assembled as a cube 50 from connectors 30 and rails 30 without panels 40.

Figure 11:
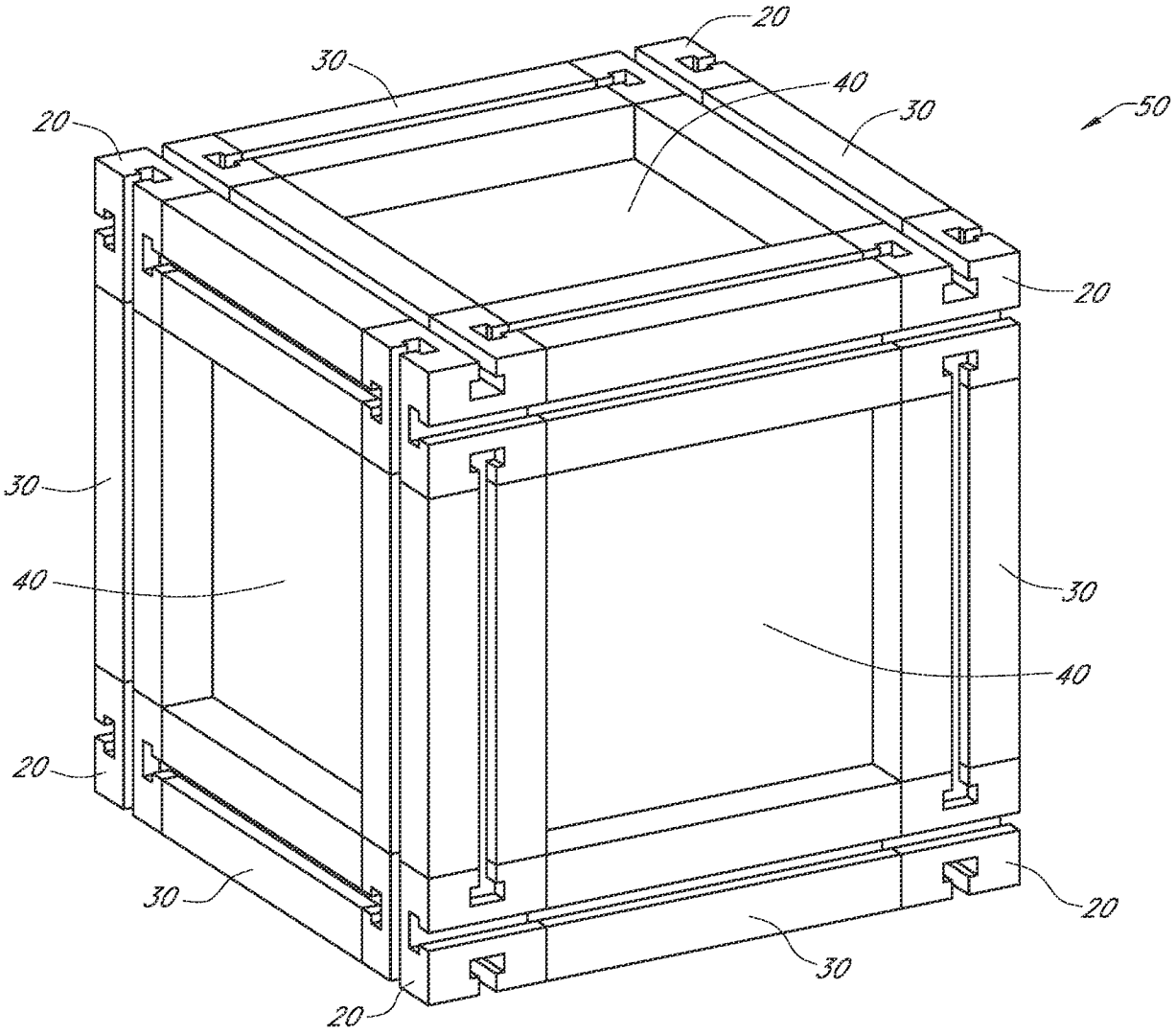

FIG. 11 illustrates the assembled cube 50 of FIG. 10 with panels 40 positioned in the rails 30.

Figure 12:
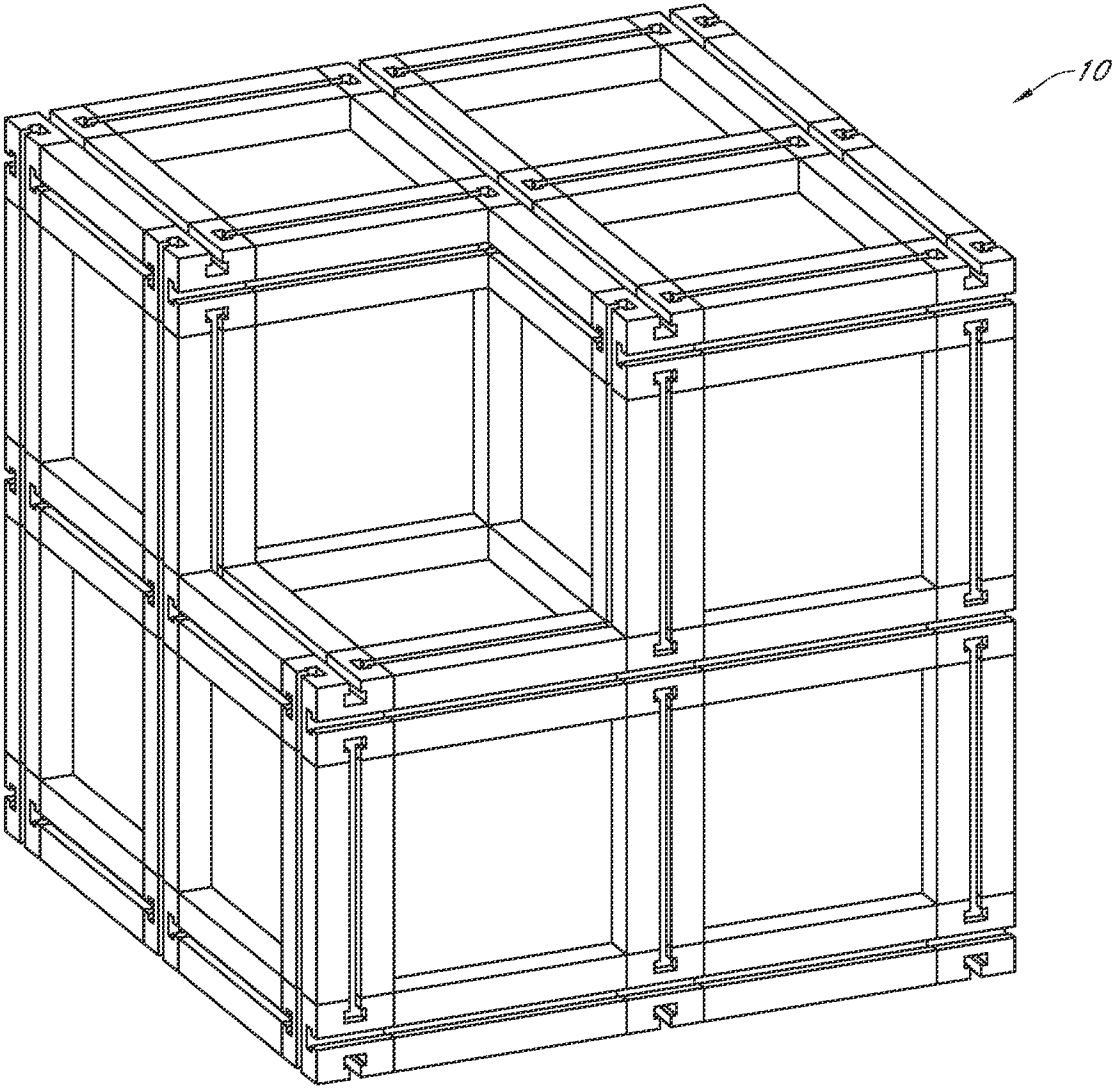

FIG. 12 illustrates an assembly configured from multiple cubes 50 which is possible with the modular system 10 disclosed herein.

Figure 13:
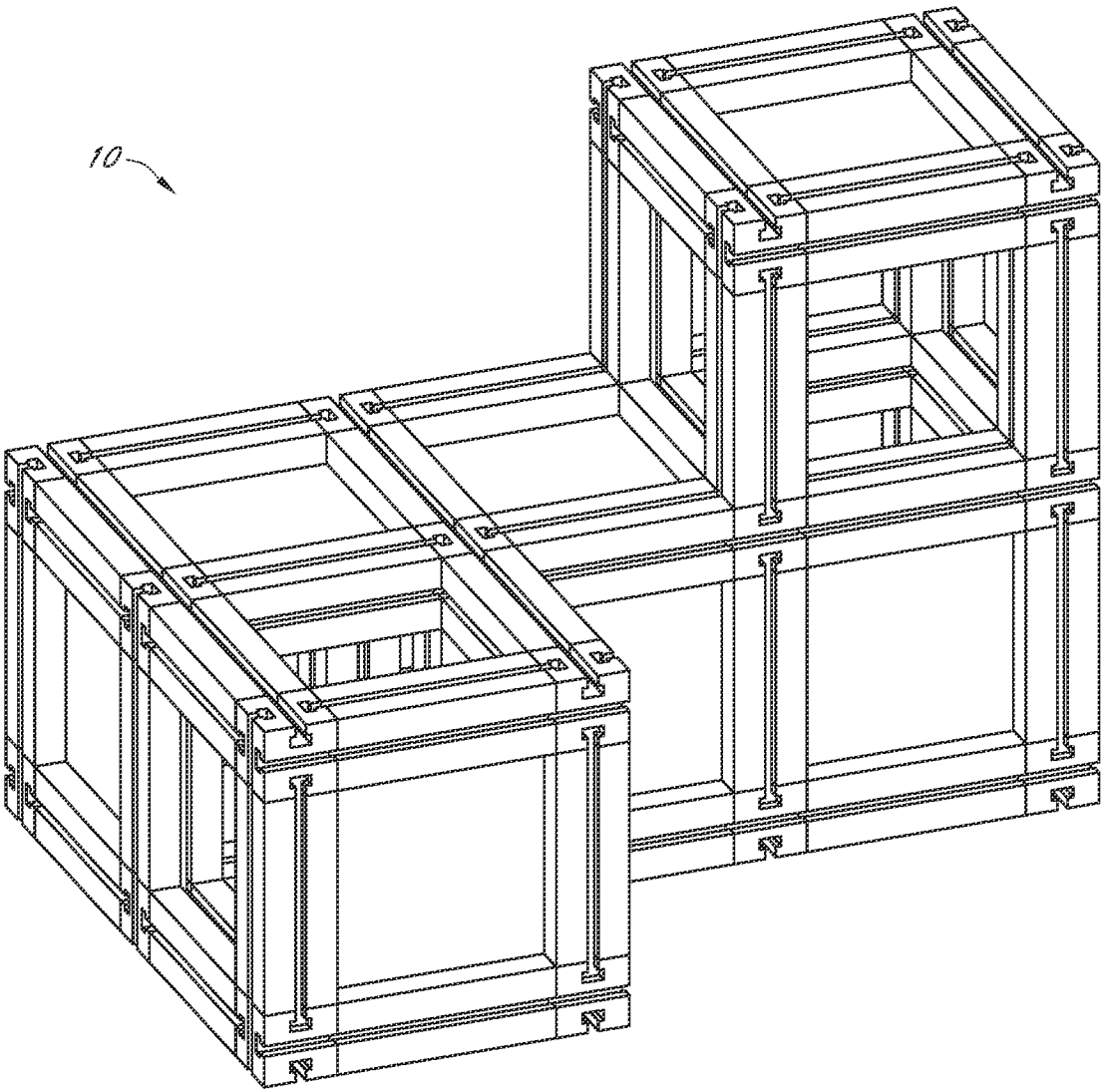

FIG. 13 illustrates another assembly configured from multiple cubes 50 which is possible with the modular system 10 disclosed herein.

DETAILED DESCRIPTION—LISTING OF ELEMENTS

| Element Description | Element Number |
|---|---|
| Modular system | 10 |
| Connector | 20 |
| Connector face | 21 |
| Slot | 24 |
| Slot first portion | 24a |
| Slot second portion | 24b |
| Rail | 30 |
| Groove | 32 |
| Groove first portion | 32a |
| Groove second portion | 32b |
| Groove side face | 34 |
| Channel side face | 35 |
| Channel | 35a |
| End face | 36 |
| Peg | 38 |
| Peg spine | 38a |
| Peg ear | 38b |
| Panel | 40 |
| Modified panel | 40' |
| Panel face | 41 |
| Standard edge | 44 |
| Rib edge | 48 |
| Rib ear | 48b |
| Modified rail | 30' |
| Modified groove | 32' |
| Locking tab | 35' |
| Biasing member | 37' |
| Cube | 50 |
| Cube (corner) | 51 |

Detailed Description of Invention

Before the present methods and apparatuses are disclosed and described, it is to be understood that the methods and apparatuses are not limited to specific methods, specific components, or to particular implementations. It is also to be understood that the terminology used herein is for the purpose of describing particular embodiments/aspects only and is not intended to be limiting. As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

"Aspect" when referring to a method, apparatus, and/or component thereof does not mean that limitation, functionality, component etc. referred to as an aspect is required, but rather that it is one part of a particular illustrative disclosure and not limiting to the scope of the method, apparatus, and/or component thereof unless so indicated in the following claims.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and apparatuses. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and apparatuses. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The present methods and apparatuses may be understood more readily by reference to the following detailed description of preferred aspects and the examples included therein and to the figures and their previous and following description.

Before the various embodiments of the present invention are explained in detail, it is to be understood that the invention is not limited in its application to the details of construction and the arrangements of components set forth in the following description. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

The following detailed description is of the best currently contemplated modes of carrying out illustrative embodiments of the invention. The description is not to be taken in a limiting sense but is made merely for the purpose of illustrating the general principles of the invention, since the scope of the invention is best defined by the appending claims. Various inventive features are described below herein that can each be used independently of one another or in combination with other features.

Illustrative Embodiments and Advantages

Figure 1:
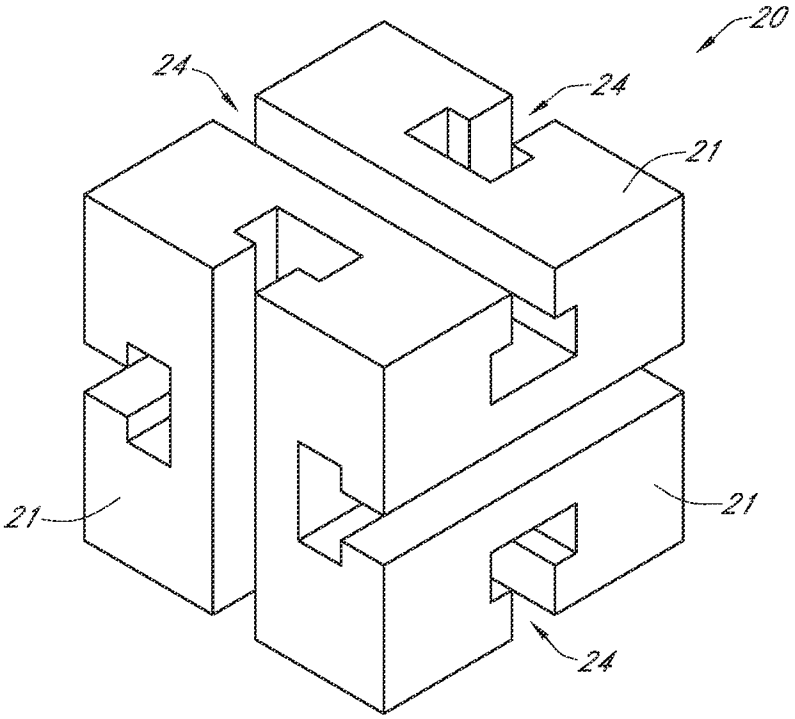
FIG. 1 is a perspective view of an illustrative embodiment of a connector 20.

A perspective view of an illustrative embodiment of a connector 20 is shown in FIG. 1. Generally, each connector 20 may be configured as a six-sided rectangular cuboid or cube. Although the illustrative embodiments of a connector 20 shown herein are configured as a cube, the scope of the present disclosure is not so limited unless otherwise indicated in the following claims. The connector 20 may include six connector faces 21 of equal dimensions.

Figure 1B:
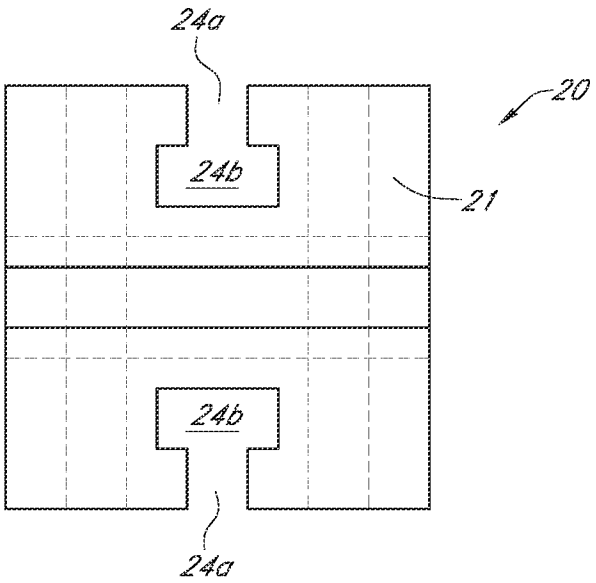
FIG. 1B is a top view of the connector 20 of FIG. 1.
Figure 1A:
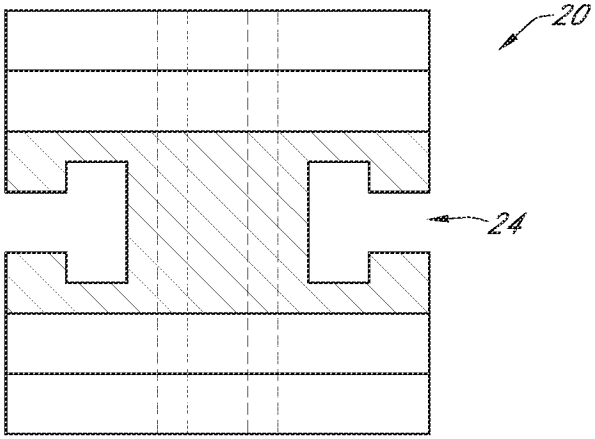
FIG. 1A is an end (sectional) view of the connector 20 of FIG. 1.

A slot 24 may be formed in each connector face 21. The slot 24 may be configured to extend inward from the connector face 21 along the length of a slot first portion 24*a* and then extend outward therefrom in a dimension parallel to the connector face 21 (and perpendicular to the length of the slot first portion 24*a*) via a slot second portion 24*b*. See FIG. 1A for an end (sectional) view of the connector 20 of FIG. 1 and FIG. 1B for a top view of the connector 20 of FIG. 1. Connector faces 21 on opposite sides from one another may slots 24 that are oriented parallel with respect to one another, and which bisect the connector face 21 in which they are formed, respectively. In the illustrative embodiment of a connector 20 picture herein, slots 24 may be orientated so that two slots 24 on each connector 20 may be oriented with a length that is parallel to the length of only one other slot 24 in each of the X, Y and Z planes. In the illustrative embodiment, slots 24 on adjacent connector faces 21 may be perpendicular to one another. Slots 24 may be aligned so that they are in the center of each connector face 21 as previously mentioned and not offset to one side or the other with respect to the connector face 21. The slots 24 may be sized, shaped, and/or otherwise configured to allow selective engagement between a connector 20 and a rail 30 via the engagement between a slot 24 in the connector 20 and a peg 38 formed on the rail 30 as described in further detail below and any suitable size, shape, and/or configuration thereof may be used without limitation unless otherwise indicated in the following claims. For example, in an illustrative embodiment not pictured herein, the slot first portion 24*a* may be generally rectilinear in cross-sectional shape and the slot second portion 24*b* may be generally circular or ovoid in cross-sectional shape.

Figure 2:
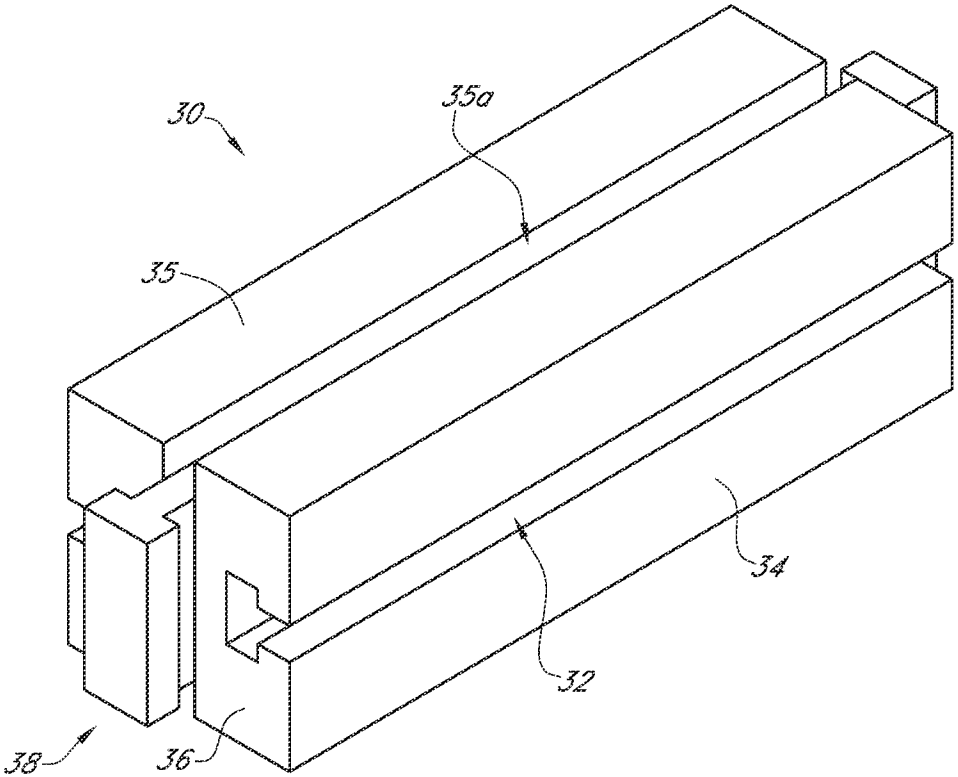
FIG. 2 is a perspective view of an illustrative embodiment of a rail 30.
Figure 2A:
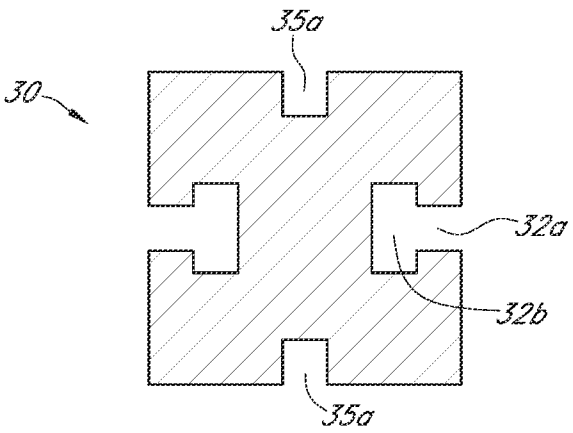
FIG. 2A is an end (sectional) view of the rail 30 of FIG. 2.
Figure 2B:
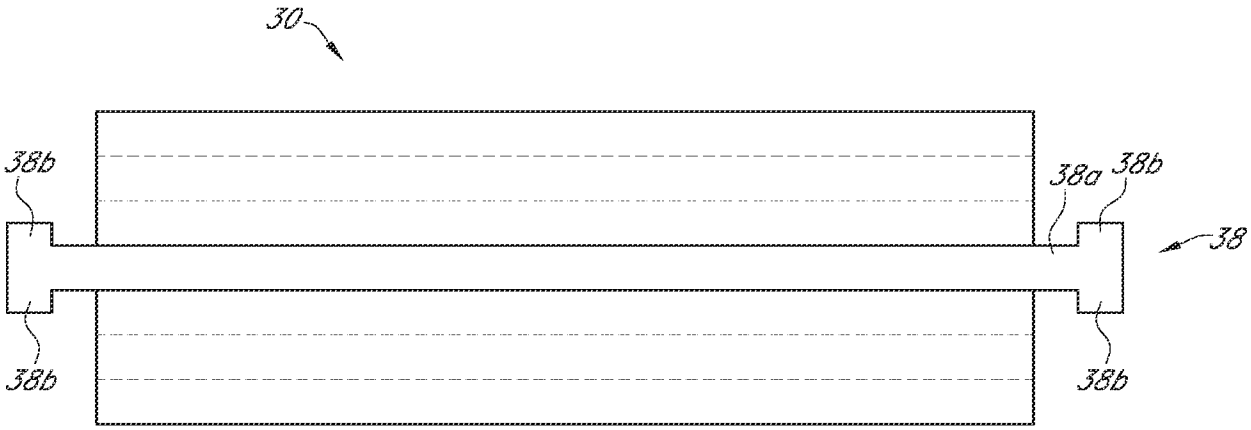
FIG. 2B is a top view of the rail 30 of FIG. 2.

A perspective view of an illustrative embodiment of a rail 30 is shown in FIG. 2. Generally, each rail 30 may be configured with a rectilinear cross-sectional shape, and in the illustrative embodiments pictured herein the cross-sectional shape may be square, but other shapes may be used without limitation unless otherwise indicated in the following claims. Generally, each rail 30 may be configured with six sides, wherein four sides are side faces 34 extending along the length of the rail 30 and two sides are end faces 36. It is contemplated that for most embodiments the shape and dimensions of the end face 36 of a rail 30 may be equal to those of the connector face 21, but other shapes, dimensions, and/or configurations may be used without limitation unless otherwise indicated in the following claims. The optimal length of each rail 30 may vary from one application to the next and is therefore in no way limiting unless otherwise indicated in the following claims. In one illustrative embodiment, each rail 30 within a given modular system 10 may be of equal length to allow for consistent grid dimensions in all three axes. However, in other illustrative embodiments the rails 30 may be of different lengths in a given embodiment of a modular system 10 without limitation unless otherwise indicated in the following claims. For example, in an illustrative embodiment it may be advantageous to have a first rail 30 with a length of 24 inches and a second rail 30 with a length of 48 inches and/or other multiples of the length of the first rail 30 without limitation unless otherwise indicated in the following claims.

Each rail 30 may be configured with a peg 38 on one or more end faces 36. Each peg 38 may be sized and shaped to engage each slot 24 in a connector 20 based on the type of fit desired between the rail 30 and the connector 20 (e.g., snug, flex, lock, etc.). The geometric shape and size of a peg 38 may be complimentary to those of the slot 24 formed in a connector 20 and may be modified to account for what type of fit is being utilized between the connector 20 and the rail 30. In an illustrative embodiment pictured herein, each peg 38 may include a peg spine 38*a* extending outward from the end face 36 in a dimension parallel to the length of the rail 30 and two peg ears 38*b* extending outward from the peg spine 38*a* in a dimension perpendicular to that of the peg spine 38*a* and length of the rail 30. The peg spine 38*a* may correspond to the slot first portion 24*a* and the peg ears 38*b* may corresponding to the slot second portion 24*b*.

Generally, any suitable shape, size, and/or configuration of pegs 38 may be used as long as once the peg 38 is engaged with a slot 24, the relative position of the rail 30 with respect to the connector is fixed in two dimensions while simultaneously allowing the rail 30 to slide along the length of that slot 24 in a third dimension. That is, once the peg 38 is engaged with a slot 24 the corresponding rail 30 may only be separated from the corresponding connector 20 by sliding the peg 38 along the length of the slot 24 until the peg 38 is clear of the slot 24, at which point the corresponding rail 30 and connector 20 are disengaged from one another. Pegs 38 and slots 24 may be designed so that when they are engaged with one another in a modular system 10 there is no movement between the corresponding rail 30 and connector 20, thus creating an inherent basis for static rigidity and structural strength of the overall assembly as described in further detail below.

Each rail 30 may be configured with a groove 32 extending along the length of the rail 30 on each groove side face 34. Each groove 32 may be configured to extend along the entire length of the groove side face 34 and may be centered therein without limitation unless otherwise indicated in the following claims. Each groove 32 may be configured to extend inward from the groove side face 34 along the length of a groove first portion 32*a* and then extend outward therefrom in a dimension parallel to the groove side face 34 (and perpendicular to the length of the groove first portion 32*a*) via a groove second portion 32*b*. It is contemplated that for most applications it will be advantageous for grooves 32 to be positioned such that the groove side faces 34 of the rail 30 are opposite from one another, wherein those grooves 32 are identical with one another, but the scope of the present disclosure is not so limited unless otherwise indicated in the following claims.

Additionally, each rail 30 may be configured with a channel 35*a* extending along the length of the rail 30 on each channel side face 35, which channel side faces 35 may be opposed to one another and adjacent to groove side faces 34 without limitation unless otherwise indicated in the following claims. Each channel 35*a* may be configured to extend along the entire length of the channel side face 35 and may be centered therein without limitation unless otherwise indicated in the following claims. Each channel 35*a* may be configured to extend inward from the channel side face 35. Accordingly, the grooves 32 on opposing groove side faces 34 and the channels 35*a* on opposing channel side faces 35 on a given rail 30 do not need to be identical to one another for various embodiments of a modular system 10. Generally, each groove 32 may be sized, shaped, and/or otherwise configured to allow selective engagement between a rail 30 and a panel 40 via the engagement between a groove 32 in the rail 30 and a rib edge 48 formed on the panel 40 as described in further detail below and any suitable size, shape, and/or configuration thereof may be used without limitation unless otherwise indicated in the following claims. Accordingly, rib edges 48 and grooves 32 may be designed so that when they are engaged with one another in a modular system 10 there is no movement between the corresponding panel 40 and rail 30, thus creating an inherent basis for static rigidity and structural strength of the overall assembly as described in further detail below.

Each channel 35*a* may be sized, shaped, and/or otherwise configured to allow selective engagement between a rail 30 and a panel 40 via the engagement between a channel 35*a* in the rail and a standard edge 44 of the panel 40 as described in further detail below and any suitable size, shape, and/or configuration thereof may be used without limitation unless otherwise indicated in the following claims. Accordingly, standard edges 44 and channels 35*a* may be designed so that when they are engaged with one another in a modular system 10 there is no movement between the corresponding panel 40 and rail 30, thus creating an inherent basis for static rigidity and structural strength of the overall assembly as described in further detail below.

A perspective view of an illustrative embodiment of a modified rail 30' is shown in FIG. 3. Generally, a modified rail 30' may be similarly configured to a rail 30 of a given modular system 10, though the modified rail 30' may be formed with a modified groove 32' along the length thereof on either a groove side face 34 or channel side face 35. The modified groove 32' may allow the modified rail 30' to engage the rib edge 48 of a panel 40 by simply inserting the rib edge 48 into the modified groove 32' as described in further detail below. FIG. 3A is another perspective view of the modified rail 30' from the other side illustrating the locking tab 35' and biasing member 37' positioned therein for locking the modified rail 30' between connectors 20. The modified rail 30' may also be formed with one or more locking tabs 35' positioned on a groove side face 34 or channel side face 35 opposite the modified groove 32'. FIG. 3B is an end view of the modified rail 30' of FIG. 3.

In an illustrative embodiment of the modified rail 30', illustrated in FIG. 3A, two locking tabs 35' may be positioned in a groove 32 with a biasing member 37' positioned between the two locking tabs 35' and configured to bias each locking tab 35' away from one another along the length of the modified rail 30'. Each locking tab 35' may be slidably engaged with the groove 32 such that the relative position of each locking tab 35' with respect to the modified rail 35' and one another is fixed in two dimensions but may be adjusted in a dimension parallel to the length of the modified rail. At least a distal portion of each locking tab 35' may be configured such that it may be positioned in a slot 24 formed in a connector 20 as described in further detail below.

A perspective view of an illustrative embodiment of a panel 40 is shown in FIG. 4. Generally, each panel 40 may be configured with a rectilinear panel face 41, at least one standard edge 44 and at least one rib edge 48. In the illustrative embodiment of a panel 40 pictured herein the panel face 41 may be square and two standard edges 44 may be opposed to and parallel with respect to one another and two rib edges 48 may be opposed to and parallel to one another (both being perpendicular to the standard edges 44).

The standard edges 44 may be configured with a thickness that is equal to the thickness of the panel face 41 and the rib edges 48 may be configured with rib ears 48*b* extending outward from the panel face 41. Each rib edge 48 may be sized and shaped to engage a groove 32 formed in a rail 30 based on the type of fit desired between the panel 40 and the rail 30 (e.g., snug, flex, lock, etc.). The geometric shape and size of a rib edge 48 may be complimentary to those of the groove 32 formed in a rail 30 and may be modified to account for what type of fit is being utilized between the panel 40 and the rail 30. In an illustrative embodiment pictured herein, a portion of the rib edge 48 that is of the same thickness as the panel face 41 may correspond to the groove first portion 32*a* and the rib ears 48*b* may corresponding to the groove second portion 32*b*.

In the illustrative embodiment of a modular system 10 as pictured herein, it is contemplated that the size, shape, and/or configuration of the slot 24 in a connector 20 be the same as those of the groove 32 in a rail 30 and that that the size, shape, and/or configuration of the peg 38 in a rail 30 be the same as those of the rib edge 48 of a panel 40, and that the thickness of the panel face 41 be equal or approximately equal to the thickness of the slot first portion 24*a* and/or groove first portion 32*a*. However, the scope of the present disclosure is not so limited unless otherwise indicated in the following claims.

Generally, any suitable shape, size, and/or configuration of rib edges 48 may be used as long as once the rib edge 48 is engaged with a groove 32, the relative position of the rail 30 with respect to the panel 40 is fixed in two dimensions while simultaneously allowing the panel 40 to slide along the length of that groove 32 in a third dimension. That is, once the rib edge 48 is engaged with a groove 32 the corresponding rail 30 may only be separated from the corresponding panel 40 by sliding the panel 40 (and, consequently the rib edge 48) along the length of the groove 32 until the rib edge 48 is clear of the groove 32, at which point the corresponding rail 30 and panel 40 are disengaged from one another. Rib edges 48 and groove 32 may be designed so that when they are engaged with one another in a modular system 10 there is no movement between the corresponding rail 30 and panel 40, thus creating an inherent basis for static rigidity and structural strength of the overall assembly as described in further detail below. Additionally, any suitable shape, size, and/or configuration of a standard edge 44 may be used such that the standard edge 44 may be inserted into a channel 35*a* without limitation unless otherwise indicated in the following claims and as described in further detail below.

Generally, for the illustrative embodiment of a modular system panels 40 may be engaged with at least one assembled connector 20 and rail 30 combination, wherein the panel 40 may provide material to fill the space between various connectors 20 and rails 40. However, any connector 20 and/or rail 30 may be selectively engaged with a suitable panel 40 and any dimensional rectilinear shape completed with at least two connectors 20 and at least three rails 20 within the overall modular system 10 may be engaged with a panel 40, and subsequent connectors 20 and/or rails 30 may be added to complete a symmetrical rectilinear shape of without limitation unless otherwise indicated in the following claims. Generally, the dimensions of a panel 40 (and specifically the length and height thereof not including the rib edges 48) may be optimized according to the length of a rail 30 not accounting for the pegs 38, and in the illustrative embodiment may be equal thereto without limitation unless otherwise indicated in the following claims. The optimal thickness of a panel 40 may vary from one application of the modular system 10 to the next, but it is contemplated that the maximum thickness thereof may be determined by the width of a rail 30, such that the maximum panel 40 thickness does not exceed the width of the rail 30 without limitation unless otherwise indicated in the following claims.

Panels 40 may be configured to fill certain spaces/voids that would otherwise exist between connectors 20 and/or rails 30 in a modular system 10, and the specific placement, presence, or absence of a panel 40 adjacent a specific connector 20 and/or rail 30 will vary from one embodiment of the modular system 10 to the next and is therefore in no way limiting to the scope thereof unless otherwise indicated in the following claims. That is, for one application of a modular system 10 it may be advantageous to have an empty space within an area defined by four connectors 20 and four rails 30, and in another application, it may be advantageous to use a panel 40 to fill such an area without limitation unless otherwise indicated in the following claims. The specific size, shape, and/or configuration of a given panel 40 may be determined at least by the sizes, shapes, and/or configuration of the rails 30, and particularly the length of the rails 30. In one illustrative embodiment the length of at least one side of a panel 40 (either along a standard edge 44 or a rib edge 48 without limitation unless otherwise indicated in the following claims) may be equal to the length of a rail 30 alone, and in another illustrative embodiment it may be equal to the total length of a rail 30 engaged with a connector 20 on one end face 36 of the rail 30, and in still another illustrative embodiment it may be equal to the total length of a rail 30 engaged with a connector 20 on both end faces 36 of the rail 30.

A modified panel 40' is shown in FIG. 5, wherein the modified panel 40' may be configured similarly to a given panel 40 of a modular system 10. However, a modified panel 40' may include only one rib edge 48 as opposed to two rib edges 48 in a typical panel 40. A modified panel 40 so configured may allow for construction of a three-dimensional modular system 10 by allowing a rail 30 to be engaged with the modified panel 40' such that a standard edge 44 of the modified panel 40' (which standard edge 44 would typically be configured as a rib edge 48 in the other panels 40) may be inserted into a groove 32 in the rail 30 as described in further detail below.

Illustrative Assembly of a Modular Interlocking Assembly System

FIGS. 6-12 illustrate at least one method of use and assembly of a modular interlocking cubic assembly system using at least one embodiment of the connector(s) 20, rail(s) 30 and panel(s) 40 as disclosed and discussed herein. FIG. 6 illustrates a connector 20 and three rails 30 prior to connection and assembly. As shown herein and previously disclosed, one connector 20 allows for up to six (6) rails 30 to be connected therein. As shown, the three (3) rails 30, each on a different axis set at a location where only one movement is needed per rail 30 to allow for their connection.

FIG. 7 illustrates the connector 20 and three (3) rails 30 assembled together from FIG. 6.

FIG. 8 illustrates a rail 30 and two panels 40. As shown herein and previously disclosed two panels 40 could be engaged with a rail 30.

FIG. 9 illustrates a connector 20 fitted together with three (3) rails 30 and three (3) panels 40 to form a corner 51 of a cube 50 constructed with at least one embodiment of the modular system disclosed herein. As will be apparent to one of ordinary skill, the connector 20 has three (3) rails 30 inserted in each of the X, Y, and Z directions and three (3) panels 40 are fitted in each of the X, Y, and Z planes.

FIG. 10 illustrates a cube 50 assembled from connectors 20 and rails 30 without panels 40. Eight (8) connectors 20 and twelve rails 30 make up a completed cube 50 without any panels 40 in positioned in the rails 30. As configured, this is an open-faced cube 50 structure that shows the placement of each component. FIG. 10 further illustrates the possibilities of the modular system 10 and the potential to add components outward in each direction. One of ordinary skill will appreciate that the assembly of a cube 50 with five (5) panels 40 can be achieved by fitting together the connectors 20, rails 30 and panels 40 as disclosed herein.

FIG. 11 illustrates the assembled cube 50 of FIG. 10 with panels 40 positioned in the rails 30. Eight (8) connectors 20, twelve (12) rails 30 and six (6) panels 40 make up a completed cube 50 with all six (6) sides closed via the panels 40. Assembly of a cube 50 having all six (6) panels 40 requires the use of at least one or more modified components, either a modified panel 40' or a modified rail 30'. One of ordinary skill will appreciate that a fully enclosed cube may also be assembled by substituting two (2) of the panels 40 with modified panels 40' as disclosed at FIG. 5. Another way to assemble a fully enclosed cube 50 is to substitute one rail 30 for a modified rail 30' that is not prevented from completing the cube by the panel rib, as understood from FIGS. 3-3B.

FIG. 12 illustrates another assembly possible with the modular system 10 disclosed herein. The design properties of each component allow for virtually any combination of assembled cubes 50 to be created. As shown, this configuration has panels 40 inserted between the rails 30 so that all sides have "closed faces".

FIG. 13 illustrates another assembly possible with the modular system 10 disclosed herein. The design properties of each component allow for virtually any combination of assembled cubes 50 to be created. As shown, this configuration has a number of panels 40 inserted between a number of the rails 30 so that a portion of the sides have "closed faces" with the remaining having "open faces".

Generally, any of the aforementioned components may be constructed of any suitable materials currently existing or later developed, which suitability may depend at least on the application of the modular system 10, which materials include but are not limited to metals and their alloys, plastics, polymers, natural materials, and/or combinations thereof without limitation unless otherwise indicated in the following claims. In on illustrative embodiment, the panels 40 may be injection molded, but other manufacturing methods may be utilized to manufacture panels 40 without limitation unless otherwise indicated in the following claims. In one illustrative embodiment panels 40 may be constructed as a hybrid component and comprised of multiple different parts that are different materials. Panels 40 may have various designs and may be constructed to be solid, translucent, mesh, screened, include a door, include slots or other access apertures, etc. without limitation unless otherwise indicated in the following claims. In many applications it is contemplated that one or more panels 40 may be modified without a detrimental effect on the proper or desired functionality of the modular system 10.

Additionally, rails 30 and pegs 38 do not need to be made from the same material. Other materials may be used depending on the intended use. Modification of rails 30 may be performed to enable proper functioning of a modular system 10 configured for a specific application. In one illustrative embodiment the rails 30 may be manufactured by an extrusion process. However, different manufacturing methods could be utilized to manufacture rails 30 without limitation unless otherwise indicated in the following claims. Rail 30 and pegs 38 may be separately manufactured and then engaged with one another or may integrally formed with one another without limitation unless otherwise indicated in the following claims.

In an illustrative embodiment the connectors 20 may be manufactured via an injection molding process. Different manufacturing methods could be utilized to manufacture connectors. However, different manufacturing methods could be utilized to manufacture rails 30 without limitation unless otherwise indicated in the following claims. It is contemplated that for at least some applications, plastics and metals may be advantageous materials for constructing the connectors 30 without limitation unless otherwise indicated in the following claims.

Modification of rails 30 may be performed to enable proper functioning of a modular system 10 configured for a specific application. The size, shape, geometry, dimensions, relative locations, and/or configuration of the connector 20 and various components thereof (e.g., connector face 21, slot 24, etc.) may vary significantly from one illustrative embodiment of a connector 20 to the next, and the optimal size, shape, geometry, dimensions, and/or configuration thereof may be dependent at least on other components of a modular system 10 for which the connector 20 is designed. Additionally, differently sized, shaped, dimensioned, and/or configured connectors 20 may be used together in a single modular system 10 for certain applications thereof without limitation unless otherwise indicated in the following claims. Accordingly, the scope of a connector 20 is in no way limited by those specific considerations unless otherwise indicated in the following claims.

Similarly, the size, shape, geometry, dimensions, relative locations, and/or configuration of the rail 30 and various components thereof (e.g., groove 32, groove side face 34, channel side face 35, channel 35*a*, end face 36, peg 38, etc.) may vary significantly from one illustrative embodiment of a rail 30 to the next, and the optimal size, shape, geometry, dimensions, and/or configuration thereof may be dependent at least on other components of a modular system 10 for which the rail 30 is designed. Additionally, differently sized, shaped, dimensioned, and/or configured rails 30 may be used together in a single modular system 10 for certain applications thereof without limitation unless otherwise indicated in the following claims. Accordingly, the scope of a rail 30 is in no way limited by those specific considerations unless otherwise indicated in the following claims.

Finally, the size, shape, geometry, dimensions, relative locations, and/or configuration of the panel 40 and various components thereof (e.g., panel face 41, standard edge 44, rib edge 48, etc.) may vary significantly from one illustrative embodiment of a panel 40 to the next, and the optimal size, shape, geometry, dimensions, and/or configuration thereof may be dependent at least on other components of a modular system 10 for which the panel 40 is designed. Additionally, differently sized, shaped, dimensioned, and/or configured panels 40 may be used together in a single modular system 10 for certain applications thereof without limitation unless otherwise indicated in the following claims. Accordingly, the scope of a panel 40 is in no way limited by those specific considerations unless otherwise indicated in the following claims. The various relative dimensions of the components of the modular system 10 may be infinitely varied depending on the specific application of the modular system 10. Several illustrative aspects of different modular system 10 according to the present disclosure and dimensions of the components of illustrative embodiments of a modular system 10 are shown and described herein. However, these aspects and dimensions are not meant to be limiting in any sense, but rather are provided to show how the various dimensions of the modular system 10 and/or components thereof may be manipulated without limitation unless otherwise indicated in the following claims.

Having described preferred aspects of the various processes, apparatuses, and products made thereby, other features of the present disclosure will undoubtedly occur to those versed in the art, as will numerous modifications and alterations in the embodiments and/or aspects as illustrated herein, all of which may be achieved without departing from the spirit and scope of the present disclosure. Accordingly, the methods and embodiments pictured and described herein are for illustrative purposes only, and the scope of the present disclosure extends to all processes, apparatuses, and/or structures for providing the various benefits and/or features of the present disclosure unless so indicated in the following claims.

While the process, process steps, components thereof, apparatuses therefor and results produced according to the present disclosure have been described in connection with preferred aspects and specific examples, it is not intended that the scope be limited to the particular embodiments and/or aspects set forth, as the embodiments and/or aspects herein are intended in all respects to be illustrative rather than restrictive. Accordingly, the processes and embodiments pictured and described herein are no way limiting to the scope of the present disclosure unless so stated in the following claims.

Although several figures are drawn to accurate scale, any dimensions provided herein are for illustrative purposes only and in no way limit the scope of the present disclosure unless so indicated in the following claims. It should be noted that the processes, software and methods disclosed are not limited to the specific embodiments pictured and described herein, but rather the scope of the inventive features according to the present disclosure is defined by the claims herein. Modifications and alterations from the described embodiments will occur to those skilled in the art without departure from the spirit and scope of the present disclosure.

Any of the various features, components, functionalities, advantages, aspects, configurations, process steps etc. of a computerized transaction, a process step, and/or an application, may be used alone or in combination with one another depending on the compatibility of the features, components, functionalities, advantages, aspects, configurations, process steps, process parameters, etc. Accordingly, an infinite number of variations of the present disclosure exist. Modifications and/or substitutions of one feature, component, functionality, aspect, configuration, process step, process parameter, etc. for another in no way limit the scope of the present disclosure unless so indicated in the following claims.

It is understood that the present disclosure extends to all alternative combinations of one or more of the individual features mentioned, evident from the text and/or drawings, and/or inherently disclosed. All of these different combinations constitute various alternative aspects of the present disclosure and/or components thereof. The embodiments described herein explain the best modes known for practicing the apparatuses, methods, and/or components disclosed herein and will enable others skilled in the art to utilize the same. The claims are to be construed to include alternative embodiments to the extent permitted by the prior art.

Unless otherwise expressly stated in the claims, it is in no way intended that any process or method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including but not limited to: matters of logic with respect to arrangement of steps or operational flow; plain meaning derived from grammatical organization or punctuation; the number or type of embodiments described in the specification. To aid the Patent Office and any readers of any patent issued on this application in interpreting the claims appended hereto, applicants wish to note that they do not intend any of the appended claims or claim elements to invoke 35 U.S.C. 112 (f) unless the words "means for" or "step for" are explicitly used in the particular claim.

The invention claimed is:

1. A modular system comprising:

a. a first connector shaped as a rectangular cuboid having six connector faces, wherein each said connector face is formed with a T-shaped slot bisecting said connector face and extending inward from said connector face;

b. a rail having a rectilinear cross-sectional shape and a length, said rail comprising:

i. a first groove side face;

ii. a first channel side face adjacent to said first groove side face;

iii. a first end face oriented in a plane that is perpendicular to both said first groove side face and said first channel side face;

iv. a first peg extending outward from said first end face, wherein said first peg is configured with a cross-sectional shape and size such that said first peg is slidably engageable with each said slot of said first connector such that, as said first peg is positioned in said slot, a position of said rail is simultaneously fixed with respect to a position of said first connector in two dimensions but moveable along a length of said slot;

v. a groove formed in said first groove side face and extending along said length of said rail;

vi. a channel formed in said first channel side face and extending along said length of said rail;

c. a panel having a length, a width, and a thickness, said panel comprising:

i. a panel face constituting said length and said width of said panel, wherein said panel face is rectilinear in shape;

ii. a standard edge along said length of said panel face, wherein said standard edge is configured to be selectively inserted into said channel; and, iii. a rib edge along said width of said panel face, wherein said rib edge is configured with a cross-sectional shape and size such that said panel is slidably engageable with said groove formed in said first groove side face of said rail such that, as said rib edge is positioned in said groove, a position of said panel is simultaneously fixed with respect to the position of said rail in two dimensions but moveable along said length of said rail.

2. The modular system according to claim 1 wherein said rail further comprises:

a. a second channel side face opposed to said channel side face and adjacent said groove side face;

b. a second groove side face opposed to said groove side face and adjacent said channel side face and said second channel side face;

c. a groove formed in said second groove side face, wherein said groove in said second groove side face is identical to said groove in said first groove side face;

d. a channel formed in said second channel side face, wherein said channel in said second channel side face is identical to said channel in said first channel side face;

e. a second end face oriented in a second plane that is perpendicular to both said first groove side face and said first channel side face, wherein said second end face is on an opposite end of said rail from said first end face; and, f. a second peg extending outward from said second end face, wherein said second peg is configured with a cross-sectional shape and size identical to those of said first peg.

3. The modular system according to claim 2 further comprising:

a. a second connector shaped as a rectangular cuboid having six second connector faces, wherein each said second connector face is formed with a slot bisecting said second connector face and extending inward from said second connector face;

b. a third connector shaped as a rectangular cuboid having six third connector faces, wherein each said third connector face is formed with a slot bisecting said third connector face and extending inward from said third connector face;

c. a fourth connector shaped as a rectangular cuboid having six fourth connector faces, wherein each said fourth connector face is formed with a slot bisecting said fourth connector face and extending inward from said fourth connector face;

d. a fifth connector shaped as a rectangular cuboid having six fifth connector faces, wherein each said fifth connector face is formed with a slot bisecting said fifth connector face and extending inward from said fifth connector face; and, e. a sixth connector shaped as a rectangular cuboid having six sixth connector faces, wherein each said sixth connector face is formed with a slot bisecting said sixth connector face and extending inward from said sixth connector face, wherein said connector, said second connector, said third connector, said fourth connector, said fifth connector, and said sixth connector are interchangeable.

4. The modular system according to claim 3 further comprising a second rail having a rectilinear cross-sectional shape and a length, said second rail comprising:

a. a first groove side face;

b. a first channel side face adjacent to said first groove side face;

c. a first end face oriented in a plane that is perpendicular to both said first groove side face and said first channel side face;

d. a first peg extending outward from said first end face, wherein said first peg is configured with a cross-sectional shape and size such that said first peg is slidably engageable with each said slot of said first connector such that when said first peg is positioned in said slot a position of said second rail is simultaneous fixed with respect to a position of said first connector in two dimensions but moveable along a length of said slot;

e. a groove formed in said first groove side face and extending along said length of said second rail;

f. a channel formed in said first channel side face and extending along said length of said second rail;

g. a second channel side face opposed to said channel side face and adjacent said groove side face;

h. a second groove side face opposed to said groove side face and adjacent said channel side face and said second channel side face;

i. a groove formed in said second groove side face, wherein said groove in said second groove side face is identical to said groove in said first groove side face;

j. a channel formed in said second channel side face, wherein said channel in said second channel side face is identical to said channel in said first channel side face;

k. a second end face oriented in a second plane that is perpendicular to both said first groove side face and said first channel side face, wherein said second end face is on an opposite end of said second rail from said first end face; and, l. A second peg extending outward from said second end face, wherein said second peg is configured with a cross-sectional shape and size identical to those of said first peg.

5. The modular system according to claim 4 further comprising a third rail having a rectilinear cross-sectional shape and a length, said third rail comprising:

a. a first groove side face;

b. a first channel side face adjacent to said first groove side face;

c. a first end face oriented in a plane that is perpendicular to both said first groove side face and said first channel side face;

d. a first peg extending outward from said first end face, wherein said first peg is configured with a cross-sectional shape and size such that said first peg is slidably engageable with each said slot of said first connector such that when said first peg is positioned in said slot a position of said third rail is simultaneous fixed with respect to a position of said first connector in two dimensions but moveable along a length of said slot;

e. a groove formed in said first groove side face and extending along said length of said third rail;

f. a channel formed in said first channel side face and extending along said length of said third rail;

g. a second channel side face opposed to said channel side face and adjacent said groove side face;

h. a second groove side face opposed to said groove side face and adjacent said channel side face and said second channel side face;

i. a groove formed in said second groove side face, wherein said groove in said second groove side face is identical to said groove in said first groove side face;

j. a channel formed in said second channel side face, wherein said channel in said second channel side face is identical to said channel in said first channel side face;

k. a second end face oriented in a second plane that is perpendicular to both said first groove side face and said first channel side face, wherein said second end face is on an opposite end of said third rail from said first end face; and, l. A second peg extending outward from said second end face, wherein said second peg is configured with a cross-sectional shape and size identical to those of said first peg.

6. The modular system according to claim 5 further comprising a fourth rail having a rectilinear cross-sectional shape and a length, said fourth rail comprising:

a. a first groove side face;

b. a first channel side face adjacent to said first groove side face;

c. a first end face oriented in a plane that is perpendicular to both said first groove side face and said first channel side face;

d. a first peg extending outward from said first end face, wherein said first peg is configured with a cross-sectional shape and size such that said first peg is slidably engageable with each said slot of said first connector such that when said first peg is positioned in said slot a position of said fourth rail is simultaneous fixed with respect to a position of said first connector in two dimensions but moveable along a length of said slot;

e. a groove formed in said first groove side face and extending along said length of said fourth rail;

f. a channel formed in said first channel side face and extending along said length of said fourth rail;

g. a second channel side face opposed to said channel side face and adjacent said groove side face;

h. a second groove side face opposed to said groove side face and adjacent said channel side face and said second channel side face;

i. a groove formed in said second groove side face, wherein said groove in said second groove side face is identical to said groove in said first groove side face;

j. a channel formed in said second channel side face, wherein said channel in said second channel side face is identical to said channel in said first channel side face;

k. a second end face oriented in a second plane that is perpendicular to both said first groove side face and said first channel side face, wherein said second end face is on an opposite end of said fourth rail from said first end face; and, l. A second peg extending outward from said second end face, wherein said second peg is configured with a cross-sectional shape and size identical to those of said first peg.

7. The modular system according to claim 6 further comprising a fifth rail having a rectilinear cross-sectional shape and a length, said fifth rail comprising:

a. a first groove side face;

b. a first channel side face adjacent to said first groove side face;

c. a first end face oriented in a plane that is perpendicular to both said first groove side face and said first channel side face;

d. a first peg extending outward from said first end face, wherein said first peg is configured with a cross-sectional shape and size such that said first peg is slidably engageable with each said slot of said first connector such that when said first peg is positioned in said slot a position of said fifth rail is simultaneous fixed with respect to a position of said first connector in two dimensions but moveable along a length of said slot;

e. a groove formed in said first groove side face and extending along said length of said fifth rail;

f. a channel formed in said first channel side face and extending along said length of said fifth rail;

g. a second channel side face opposed to said channel side face and adjacent said groove side face;

h. a second groove side face opposed to said groove side face and adjacent said channel side face and said second channel side face;

i. a groove formed in said second groove side face, wherein said groove in said second groove side face is identical to said groove in said first groove side face;

j. a channel formed in said second channel side face, wherein said channel in said second channel side face is identical to said channel in said first channel side face;

k. a second end face oriented in a second plane that is perpendicular to both said first groove side face and said first channel side face, wherein said second end face is on an opposite end of said fifth rail from said first end face; and, l. A second peg extending outward from said second end face, wherein said second peg is configured with a cross-sectional shape and size identical to those of said first peg.

8. The modular system according to claim 7 further comprising a sixth rail having a rectilinear cross-sectional shape and a length, said sixth rail comprising:

a. a first groove side face;

b. a first channel side face adjacent to said first groove side face;

c. a first end face oriented in a plane that is perpendicular to both said first groove side face and said first channel side face;

d. a first peg extending outward from said first end face, wherein said first peg is configured with a cross-sectional shape and size such that said first peg is slidably engageable with each said slot of said first connector such that when said first peg is positioned in said slot a position of said sixth rail is simultaneous fixed with respect to a position of said first connector in two dimensions but moveable along a length of said slot;

e. a groove formed in said first groove side face and extending along said length of said sixth rail;

f. a channel formed in said first channel side face and extending along said length of said sixth rail;

g. a second channel side face opposed to said channel side face and adjacent said groove side face;

h. a second groove side face opposed to said groove side face and adjacent said channel side face and said second channel side face;

i. a groove formed in said second groove side face, wherein said groove in said second groove side face is identical to said groove in said first groove side face;

j. a channel formed in said second channel side face, wherein said channel in said second channel side face is identical to said channel in said first channel side face;

k. a second end face oriented in a second plane that is perpendicular to both said first groove side face and said first channel side face, wherein said second end face is on an opposite end of said sixth rail from said first end face; and, l. A second peg extending outward from said second end face, wherein said second peg is configured with a cross-sectional shape and size identical to those of said first peg.

9. The modular system according to claim 8 further comprising seventh, eighth, ninth, tenth, eleventh, and twelfth rails, wherein said eighth, ninth, tenth, eleventh, and twelfth rails are interchangeable with said sixth rail and identical to one another.

10. The modular system according to claim 9 further comprising a second panel having a length, a width, and a thickness, said second panel comprising:

a. a second panel face constituting said length and said width of said second panel, wherein said second panel face is rectilinear in shape;

b. a standard edge along said length of said second panel face, wherein said standard edge is configured to be selectively inserted into said channel; and, c. a rib edge along said width of said second panel face, wherein said rib edge is configured with a cross-sectional shape and size such that said second panel is slidably engageable with said groove of formed in said first groove side face of said rail such that when said rib edge is positioned in said groove a position of said second panel is simultaneous fixed with respect to a position of said rail in two dimensions but moveable along said length of said rail.

11. The modular system according to claim 10 further comprising a third panel having a length, a width, and a thickness, said third panel comprising:

a. a third panel face constituting said length and said width of said third panel, wherein said third panel face is rectilinear in shape;

b. a standard edge along said length of said third panel face, wherein said standard edge is configured to be selectively inserted into said channel; and, c. a rib edge along said width of said third panel face, wherein said rib edge is configured with a cross-sectional shape and size such that said third panel is slidably engageable with said groove of formed in said first groove side face of said rail such that when said rib edge is positioned in said groove a position of said third panel is simultaneous fixed with respect to a position of said rail in two dimensions but moveable along said length of said rail.

12. The modular system according to claim 11 further comprising a fourth panel having a length, a width, and a thickness, said fourth panel comprising:

a. a fourth panel face constituting said length and said width of said fourth panel, wherein said fourth panel face is rectilinear in shape;

b. a standard edge along said length of said fourth panel face, wherein said standard edge is configured to be selectively inserted into said channel; and, c. a rib edge along said width of said fourth panel face, wherein said rib edge is configured with a cross-sectional shape and size such that said fourth panel is slidably engageable with said groove of formed in said first groove side face of said rail such that when said rib edge is positioned in said groove a position of said fourth panel is simultaneous fixed with respect to a position of said rail in two dimensions but moveable along said length of said rail.

13. The modular system according to claim 12 further comprising a fifth panel having a length, a width, and a thickness, said fifth panel comprising:

a. a fifth panel face constituting said length and said width of said fifth panel, wherein said fifth panel face is rectilinear in shape;

b. a standard edge along said length of said fifth panel face, wherein said standard edge is configured to be selectively inserted into said channel; and, c. a rib edge along said width of said fifth panel face, wherein said rib edge is configured with a cross-sectional shape and size such that said fifth panel is slidably engageable with said groove of formed in said first groove side face of said rail such that when said rib edge is positioned in said groove a position of said fifth panel is simultaneous fixed with respect to a position of said rail in two dimensions but moveable along said length of said rail, and wherein said fifth panel is interchangeable with said fourth panel.

14. A method of assembling a cubic structure comprising:

providing a plurality of the modular systems according to claim 1; and forming eight corners using eight connectors, wherein each of the connectors is configured for engagement with three rails and wherein each of the rails is positioned in a different plane to form a cube.

15. The method according to claim 14 further comprising positioning a respective panel between at least two of said rails, said rails positioned opposite each other and in a same plane.

16. The method according to claim 14 further comprising positioning at least one respective panel between each said rail.

17. The method according to claim 14 comprising configuring at least one modified rail, said modified rail configured with a modified groove.

18. The method of according to claim 17 comprising configuring a respective modified panel to engage the rib channel of at least one respective rail.

19. The method according to claim 17 comprising configuring said modified rail with a biasing member to engage with at least one respective connector.

* * * * *